US006718736B2

(12) United States Patent
Oguri et al.

(10) Patent No.: US 6,718,736 B2
(45) Date of Patent: Apr. 13, 2004

(54) DEVICE AND METHOD FOR TOP SEAL PACKAGING

(75) Inventors: Toshio Oguri, Ritto (JP); Norio Kawanishi, Ritto (JP)

(73) Assignee: Ishida Co., Ltd., Kyoto (JP)

( * ) Notice: Subject to any disclaimer, the term of this patent is extended or adjusted under 35 U.S.C. 154(b) by 16 days.

(21) Appl. No.: 09/980,639

(22) PCT Filed: Mar. 26, 2001

(86) PCT No.: PCT/JP01/02422

§ 371 (c)(1),
(2), (4) Date: Dec. 5, 2001

(87) PCT Pub. No.: WO01/78973

PCT Pub. Date: Oct. 25, 2001

(65) Prior Publication Data

US 2002/0152726 A1 Oct. 24, 2002

(30) Foreign Application Priority Data

Apr. 14, 2000 (JP) ..... 2000-113550
Apr. 25, 2000 (JP) ..... 2000-124002

(51) Int. Cl.[7] ..... B65B 53/02; B65B 51/10

(52) U.S. Cl. ..... 53/442; 53/441; 53/373.4; 53/373.7; 53/51

(58) Field of Search ..... 53/441, 442, 453, 53/373.4, 373.7, 511, 51, 64, 67

(56) References Cited

U.S. PATENT DOCUMENTS 3,017,729 A * 1/1962 Cheeley ..... 53/442
3,460,317 A * 8/1969 Carter et al. ..... 53/442
3,775,932 A * 12/1973 Jeney ..... 53/511
3,777,452 A * 12/1973 Koenders ..... 53/441
3,874,145 A * 4/1975 Schmidt ..... 53/373.4
3,979,877 A * 9/1976 Vetter ..... 53/51
5,295,343 A * 3/1994 Ueda et al. ..... 53/373.4
5,473,861 A 12/1995 Fukunaga et al.
5,718,101 A * 2/1998 Noel et al. ..... 53/442
5,943,844 A * 8/1999 Wilhelm et al. ..... 53/442
6,021,629 A * 2/2000 Sterner, Sr. ..... 53/51
6,488,972 B1 * 12/2002 Cerani ..... 53/441

FOREIGN PATENT DOCUMENTS

JP 03-212309 A 9/1991
JP 07-267206 A 10/1995
JP 11-029107 A 2/1999

* cited by examiner

*Primary Examiner*—John Sipos
*Assistant Examiner*—Louis Huynh
(74) *Attorney, Agent, or Firm*—Shinjyu Global IP Counselors, LLP

(57) ABSTRACT

The present invention provides a wrapping device for welding a stretch film to a tray, and particularly a wrapping device that can provide a good appearance after the wrapping, and can suppress disadvantages in a transporting operation. A wrapping device 1 covers a top opening of a tray T with a stretch film Fm, welds the stretch film to the tray T, and thermally cuts it. The wrapping device 1 includes a stretch mechanism 9, a control portion and a film winding portion 53. The stretch mechanism 9 stretches the stretch film Fm. The control portion controls the stretch mechanism 9 to stretch the stretch film Fm at least before welding the stretch film Fm to the tray T. The film winding portion 53 winds up the stretch film Fm after the thermal cutting.

21 Claims, 23 Drawing Sheets

DEVICE AND METHOD FOR TOP SEAL PACKAGING

This application is the National Stage of International Application Serial No. PCT/JP01/02422, filed Mar. 26, 2001, published in Japanese.

TECHNICAL FIELD

The present invention relates to a top-seal wrapping device and a top-seal wrapping method. The present invention particularly relates to a top-seal wrapping device for covering an opening of a tray with a stretch film, welding the stretch film to a peripheral portion of the tray opening, and thermally cutting the stretch film. The present invention also relates to a top-seal wrapping method for performing such wrapping.

BACKGROUND ART

An over-wrapping method has been widely used for wrapping fresh foods, such as meat and fish, as well as processed foods such as precooked meals. In a conventional over-wrapping method, a tray is entirely wrapped with a film after arranging the intended contents or a wrapping target therein.

In the over-wrapping method, however, the tray and contents must be wrapped entirely, and the film portions must be overlapped with each other for sealing. Therefore, the film must have a size that is several times as large as the planar size of the tray. In many cases, the film portions overlap each other on the bottom of the tray, and the bottom surface of the tray is pressed against a heater plate for sealing. Therefore, the sealing ability or reliability is low.

However, a method, which will be referred to as a top-seal method, has been used instead of the over-wrap method in some cases. In the top-seal method, a film is arranged only over the opening at the top of the trap, and is welded to the peripheral portion of the tray around the opening. In this top-seal method, the required amount of film can be reduced when compared with the over-wrap method.

This top-seal method has been widely employed for wrapping mushrooms such shimeji mushrooms and others. More specifically, the top-seal method is implemented primarily in such a manner that adhesive is applied to a side surface of a tray around an opening, and ends of a film covering the opening are adhered thereto. Alternatively, the top-seal method is implemented in such a manner that a tray and a film having a larger area than the planar area of the tray are held between dies, and are welded together by pressure and heat applied thereto.

Between the above methods, the method of performing the welding with dies can hermetically seal the tray containing contents, i.e., a target to be wrapped, and therefore is superior to the over-wrap method. In the prior art, however, dedicated dies corresponding to tray forms and sizes are employed, and a hard film is used for the wrapping.

It may be envisaged to weld a stretch film (stretchable film) to the tray instead of a hard film. However, stretch film is liable to wrinkle, and when stretch film is placed over the tray the stretch file and contents may exhibit a less desirable appearance than when using the hard film. It is necessary to transport the stretch film, which is thin and does not have sufficient rigidity, to and from a position for welding. Therefore, a large and/or complicated mechanism may be required for the transportation.

DISCLOSURE OF THE INVENTION

An object of the present invention is to provide a wrapping device and a wrapping method for performing wrapping by welding a stretch film to a tray. Particularly, an object of the present invention is to provide a wrapping device and a wrapping method, which has a good appearance after the wrapping, and can employ a transporting mechanism with a compact structure.

According to a first aspect of the present invention, the present invention provides a top-seal wrapping device for covering a top opening of a tray containing a wrapping target with a stretch film, welding the stretch film to a peripheral portion of the tray around the opening, and thermally cutting the stretch film. The top-seal wrapping device includes a stretch mechanism, a control portion, and a film winding portion. The stretch mechanism stretches the stretch film. The control portion controls the stretching of the stretch film by operating the stretch mechanism at least before welding the stretch film to the tray. The film winding portion winds up the stretch film after the thermal cutting.

In the wrapping device of this aspect, the stretch film covers the opening of the tray, is welded to the peripheral portion of the tray around the opening, and is thermally cut.

The stretch film thus cut is wound up. Owing to the structure operating as described above, a transporting mechanism having a compact structure can be used for transporting a thin stretch film having low rigidity. In the prior art, the stretch film is transported by belts holding the opposite sides of the film, or by chains moving in the transporting direction and having clamps for holding the film. This requires a large and/or complicated structure, and increases costs. In contrast to this, the wrapping device of this aspect is provided with a film winding portion for ensuring the continuity of the stretch film. Therefore, a stretch film, which is thin and does not have sufficient rigidity, can be transported without holding or pinching it. Accordingly, the transporting mechanism can have a compact structure.

Further, the stretch mechanism is arranged for stretching the stretch film at least before welding the stretch film to the tray. Therefore, wrinkles of the stretch film covering the opening of the tray are expanded before welding so that the appearance is improved in the wrapped state.

According to a second aspect of the present invention, the top-seal wrapping device of the first aspect further has a feature such that the stretch film is thermally cut at a position outside a portion welded to the peripheral portion around the tray opening.

According to a third aspect of the present invention, the top-seal wrapping device of the first or second aspect further has a feature such that the control portion operates the stretch mechanism to apply a tension to a portion of the stretch film near the cut portion at least after welding the stretch film.

In this structure, the tension is applied to the portion near the cut portion after thermally cutting the stretch film. Therefore, the cutting can be completed even when an uncut portion is left. Further, the tension may also be applied to the stretch film during the thermal cutting. This allows easier cutting of the stretch film.

Since the stretch film is stretched after the cutting, problems can be suppressed such as the remaining portion of the cut stretch film clinging to the tray or the like.

According to a fourth aspect of the present invention, the top-seal wrapping device of the first, second, or third aspect further includes a film transporting mechanism and a lift mechanism. The film transporting mechanism transports the stretch film. The lift mechanism lifts the tray to push the stretch film transported by the film transporting mechanism against the tray. The control portion operates the stretch mechanism to stretch the stretch film before contact of the tray with the stretch film, and also controls the stretch mechanism to reduce tension of the stretch film after the contact of the tray with the stretch film.

In this structure, the lift mechanism pushes the tray against the stretch film to achieve a state in which the stretch film covers the opening of the tray.

Further, the stretch film is stretched before the tray comes into contact with the stretch film. Therefore, no wrinkles are present in the stretch film when it comes into contact with the tray, and the opening of the tray is covered with the stretch film without a wrinkle.

Further, tension of the stretch film is reduced after the tray comes into contact with the stretch film. Therefore, a disadvantage in which the stretch film is excessively stretched due to relative movement between the stretch film and the tray caused by the lift mechanism after contact between the stretch film and the tray can be suppressed.

According to a fifth aspect of the present invention, the top-seal wrapping device of any one of the preceding aspects further has a feature such that the stretch mechanism is arranged between a supply position of the stretch film and an end of a position of the welding.

According to a sixth aspect of the present invention, the top-seal wrapping device of any one of the preceding aspects further includes a detecting means. The detecting means detects an opening in the stretch film formed by thermal cutting. The control portion controls the stretch mechanism not to act on at least a portion of the stretch film including and neighboring the opening detected by the detecting means.

In this structure, the opening in the stretch film formed by the thermal cutting is detected. The control is performed such that the stretching of the stretch film may not be effected on the portion including and neighboring the detected opening. Thus, control is performed to stop the stretching of the stretch film having a portion, which was thermally cut and removed. Therefore, meandering and entangling of the stretch film are suppressed even if the strength and rigidity of the film are reduced due to the partial cutting.

According to a seventh aspect of the present invention, the top-seal wrapping device of any one of the preceding aspects further has a feature such that the stretch mechanism has a plurality of film holding portions for holding the stretch film.

In this structure, the plurality of film holding portions holds the stretch film. Therefore, the film holding portion can be arranged at (or moved to) the positions corresponding to the configuration of the tray for appropriately stretching the stretch film in accordance with the tray configuration.

According to an eighth aspect of the present invention, the top-seal wrapping device of the seventh aspect further has a feature such that the plurality of film holding portions can be set to have different holding forces, respectively.

According to a ninth aspect of the present invention, the top-seal wrapping device of the seventh or eighth aspect further has a feature such that the control portion changes timing of holding and releasing operations of the plurality of film holding portions based on the properties of at least one of the tray and the stretch film.

In this structure, the stretch film can be stretched in accordance with the properties of the tray such as a tray configuration and/or the properties of the stretch film such as a material of the stretch film.

According to a tenth aspect of the present invention, the top-seal wrapping device of any one of the preceding aspects further has a feature such that the stretch mechanism stretches the stretch film in at least one of either the transporting direction of the stretch film or the width direction perpendicular to said transporting direction.

According to an eleventh aspect of the present invention, the present invention provides a top-seal wrapping method for covering a top opening of a tray containing a wrapping target with a stretch film, welding the stretch film to a peripheral portion of the tray around the opening, and thermally cutting the stretch film. The top-seal wrapping method includes a film supply step, a stretch step, and a film winding step. In the film supply step, the stretch film is transported to a position above the tray. In the stretch step, the stretch film is stretched in a direction crossing the transporting direction before welding the stretch film to the tray. In the film winding step, the stretch film is wound after the thermal cutting.

According to a twelfth aspect of the present invention, the top-seal wrapping device of the first aspect further includes a film supply mechanism, a lift mechanism, a heating body, and a tray holding member. The film supply mechanism supplies the stretch film to a position above the tray. The lift mechanism lifts the tray to push the tray against the stretch film. The heating body comes into contact with the peripheral portion of the tray surrounding the opening and contacts the stretch film for welding the stretch film to the peripheral portion of the tray around the opening. The tray holding portion holds the tray when welding the stretch film to the peripheral portion of the tray around the opening.

A conventional top-seal method has been employed for wrapping mushrooms such as shimeji mushrooms and others. More specifically, the top-seal method is implemented primarily in such a manner that adhesive is applied to side surfaces of a tray around an opening. Ends of the film covering the opening are adhered thereto, or in such a manner that the tray and the film having a larger area than the planar area of the tray are held between dies. The tray and the film are welded together by pressure and heat applied thereto.

However, the conventional top-seal method described above requires dies corresponding to the forms and sizes of trays. Therefore, the over-wrap method has been widely employed rather than the top-seal method in the fields, which use various types of trays because contents must be arranged in various types of trays having different sizes and/or forms. Although the top-seal method can reduce the required amount of film and can improve the sealing performance, it is necessary in the prior art to prepare dies for each of the trays having different forms and/or sizes. Therefore, the top-seal method has not been employed in some or many cases.

For overcoming the above disadvantage of the top-seal method in the prior art, the assignee has proposed in Japanese Patent Application No. 1999-137025 a device for performing heat sealing (thermal welding) in a manner such that a heating roller is brought into contact with a peripheral portion of a tray around an opening with a film therebetween. The heating roller is pivoted around an axis for welding the film. According to this device, sealing can be effected without a problem if the trays have sizes and forms falling within appropriate ranges. In conventional devices, different dies are required for different types of trays. In the device proposed by the assignee, however, tooling change is not particularly required if the trays have sizes and forms falling within certain ranges. Thus the sealing operation can continue without a tooling change.

The assignee has also proposed, in Japanese Patent Application No. 1999-154616, a device for performing heat sealing in a manner such that a tray covered with a stretch film is pushed against a rubber sheet heated by a heater. In this device, it is not necessary to prepare dies dedicated to each of the trays of different forms and sizes, and the sealing operation can continue without tooling change even after a change to a different type of tray.

In the devices proposed in Japanese Patent Publication Nos. 1999-137025 and 1999-154616, however, the tray receives a force from the heating roller or the rubber sheet in the heat sealing operation. This force may shift a planar position of the tray so that large differences may occur in sealing pressure between various portions of a flange of the tray during the heat sealing operation. In the heat sealing operation, it is desired that the heating roller or the rubber sheet is pushed to various portions of the tray flange with uniform pressure A sealing failure may occur locally if the center of the tray shifts from the pivoting center of the heating roller or the center of the rubber sheet.

Accordingly, the top-seal wrapping device of the twelfth aspect of the present invention employs a structure for pushing the tray against the stretch film supplied to a position above the tray. Also, the heating body is brought into contact with the peripheral portion of the tray surrounding the opening and pushed against the stretch film so that the stretch film is welded to the tray. Further, the tray holding member is employed for holding the tray so that the position of the tray may not shift or deviate due to contact with the heating body when welding the stretch film to the tray. Therefore, the tray can maintain an optimum position with respect to the heating body, and the heating body can come into contact with the peripheral portion of the tray around the opening in accordance with the designed manner. This can reduce sealing failures due to positional deviation of the tray.

Positional deviation of the tray may occur linearly on a plane, angularly on a plane, and/or in a direction of the height. The tray holding member is configured in accordance with the characteristics of the device, and can hold the tray to prevent positional deviation in at least one of the above directions.

The tray holding member may be configured to be in direct contact with the tray for holding the tray, or may be configured to hold indirectly the tray by appropriate means such as suction.

According to a thirteenth aspect of the present invention, the top-seal wrapping device of the twelfth aspect further has a feature such that the tray holding member prevents shifting of the position of the tray when the tray is lifted and pushed against the stretch film.

In this structure, the tray holding member holds the tray to prevent positional deviation of the tray not only when welding the stretch film to the peripheral portion of the tray around the opening but also when the tray rises and comes into contact with the stretch film. Therefore, it is possible to prevent positional deviation of the tray due to the contact with the stretch film. Thus, sealing failure can be suppressed more effectively.

According to a fourteenth aspect of the present invention, the top-seal wrapping device of the twelfth or thirteenth aspect further has a feature such that the tray holding member comes into contact with a side surface of the tray to prevent shifting of the planar position of the tray.

According to a fifteenth aspect of the present invention, the top-seal wrapping device of the twelfth, thirteenth, or fourteenth aspect further includes a tray carrying and holding mechanism. The tray carrying and holding mechanism is configured to carry the tray thereon and to be transported to the lift mechanism together with the tray. The tray holding member is included in the tray carrying and holding mechanism. The lift mechanism lifts the tray by lifting the tray carrying and holding mechanism.

In this structure, the tray is placed on the tray carrying and holding mechanism to prevent positional deviation of the tray by the tray holding mechanism. While maintaining this state, the tray is transported to the lift mechanism by transporting the tray carrying and holding mechanism to the lift mechanism. Then, the lift mechanism lifts the tray carrying and holding mechanism to move the tray upward. Therefore, positional deviation of the tray can be prevented during transportation to the lift mechanism as well as lifting by the lift mechanism. Accordingly, the sealing (welding) by the heating body is effected on the tray located in the designed position so that the sealing can be performed more stably.

According to a sixteenth aspect of the present invention, the top-seal wrapping device of any one of the twelfth to fifteenth aspects further has a feature such that the tray carrying and holding mechanism is configured to bias the tray holding member toward the tray to adjust the planar position of the tray.

In this structure, the tray carrying and holding mechanism serves not only to prevent positional deviation of the tray by the tray holding member but also to adjust the planar position of the tray (e.g., to center the tray). When adjusting the planar position of the tray, the tray holding member is biased toward the tray. For example, a spring, an electric motor, a pneumatic cylinder, or a hydraulic cylinder may be used for biasing the tray holding member toward the tray.

As described above, the tray holding member adjusts the position of the tray, and holds the tray while preventing positional deviation of the tray. Thereby, operations such as transfer of the tray from a position adjusting portion to a holding portion are not required, thus, the structure can be simple.

According to a seventeenth aspect of the present invention, the top-seal wrapping device of any one of the twelfth to fourteenth aspects further includes position detecting means. The position detecting means detects the positional state of the tray during transportation to the lift mechanism. The control portion corrects position shift of the tray by the tray holding member based on a result of the detection by the position detecting means.

In this structure, the tray holding member corrects positional deviation of the tray, and the tray holding member also holds the tray to prevent positional deviation of the tray. In this manner, the tray holding member is used for correcting positional deviation and preventing subsequent positional deviation, thus, the device can have a simple structure.

According to an eighteenth aspect of the present invention, the top-seal wrapping device of any one of the twelfth to fourteenth aspects further includes biasing means. The biasing means biases the tray holding member toward the tray. The control portion controls a biasing force of the biasing means.

In the above structure, the tray holding member is biased toward the tray for holding the tray, and thereby prevents positional deviation of the tray. Further, to allow adjustment of the tray holding force, the control portion is configured to control the biasing force of the biasing means. Therefore, the force for holding the tray can be changed depending on parameters such as hardness and the material of the tray. For example, the holding force can be controlled to be low for soft trays, and to be high for hard trays. Thereby it is possible to suppress sealing failure due to deformation of the tray while reliably preventing positional deviation of the tray.

According to a nineteenth aspect of the present invention, the top-seal wrapping device of the eighteenth aspect further includes biasing force detecting means. The biasing force detecting means detects the biasing force applied by the biasing means. The control portion controls the biasing force of the biasing means based on a result of the detection by the biasing force detecting means.

In the aforementioned structure, since the biasing force detecting means is employed, the biasing means can be controlled while determining the actual biasing force, i.e., actual tray holding force. Therefore, a situation in which an excessively large biasing force collapses a soft tray does not occur. Further, the tray can be held with a holding force that corresponds to the properties of the tray.

According to a twentieth aspect of the present invention, the wrapping device of the eighteenth aspect further has a feature such that the control portion controls the biasing force of the biasing means corresponding to the properties of at least the tray and/or the stretch film.

In this structure, the biasing force of the biasing means, and thus the holding force for the tray can be adjusted in accordance with the properties of the tray such as hardness and material of the tray, and/or the properties of the stretch film such as thickness and material of the stretch film.

According to a twenty-first aspect of the present invention, the top-seal wrapping device of the first aspect further includes a film supply mechanism, a lift mechanism, a heating body, and a position adjusting mechanism. The film supply mechanism supplies the stretch film to a position above the tray. The lift mechanism lifts and pushes the tray against the stretch film. The heating body comes into contact with the peripheral portion of the tray surrounding the opening and being in contact with the stretch film. The heating body welds the stretch film to a peripheral portion of the tray around the opening. The position adjusting mechanism adjusts the planar position of the tray before the tray comes into contact with the stretch film.

According to the device of the above aspect, the tray is pushed against the stretch film supplied to a position above the tray. Additionally, the heating body is brought into contact with the peripheral portion of the tray, which is located around the opening and is in contact with the stretch film, for welding the stretch film to the tray. Further, the tray is located at an optimum position for the heating body when welding the tray to the stretch film, and for this purpose, the position adjusting mechanism is employed for adjusting the planar position of the tray before pushing the tray against the stretch film. Therefore, the tray located at the adjusted optimum position comes into contact with the stretch film, and is welded by the heating body to the stretch film. In this structure, as described above, the position of the tray with respect to the heating body is adjusted to be optimal so that sealing failures due to positional deviation of the tray can be suppressed.

According to a twenty-second aspect of the present invention, the top-seal wrapping method of the eleventh aspect further includes a position adjusting step, a lift step, and a welding step. The position adjusting step is executed by adjusting the planar position of the tray. The lift step is executed by lifting and pushing the tray against the stretch film. The welding step is executed by bringing a heating body into contact with the peripheral portion of the tray located around the opening and being in contact with the stretch film, and thereby welding the stretch film to the peripheral portion of the tray around the opening.

BRIEF DESCRIPTION OF THE DRAWINGS

FIG. 15 is a plan view showing the members arranged when the tray carrying and holding mechanism is pushed in;

DESCRIPTION OF THE PREFERRED EMBODIMENTS

[Schematic Structure of Device]

Figure 1:
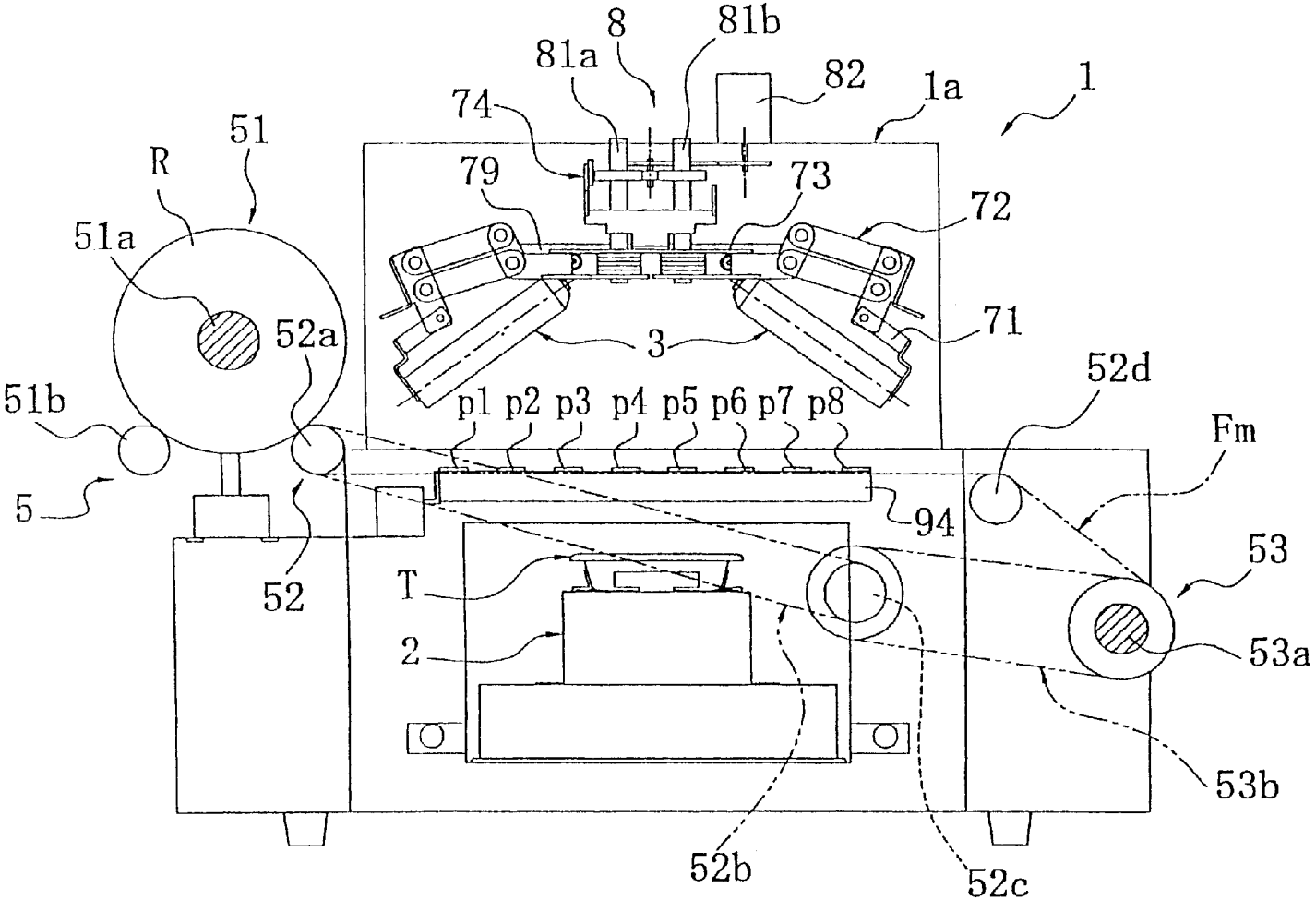
FIG. 1 is a cross-sectional view of a wrapping device according to an embodiment of the present invention.
Figure 2:
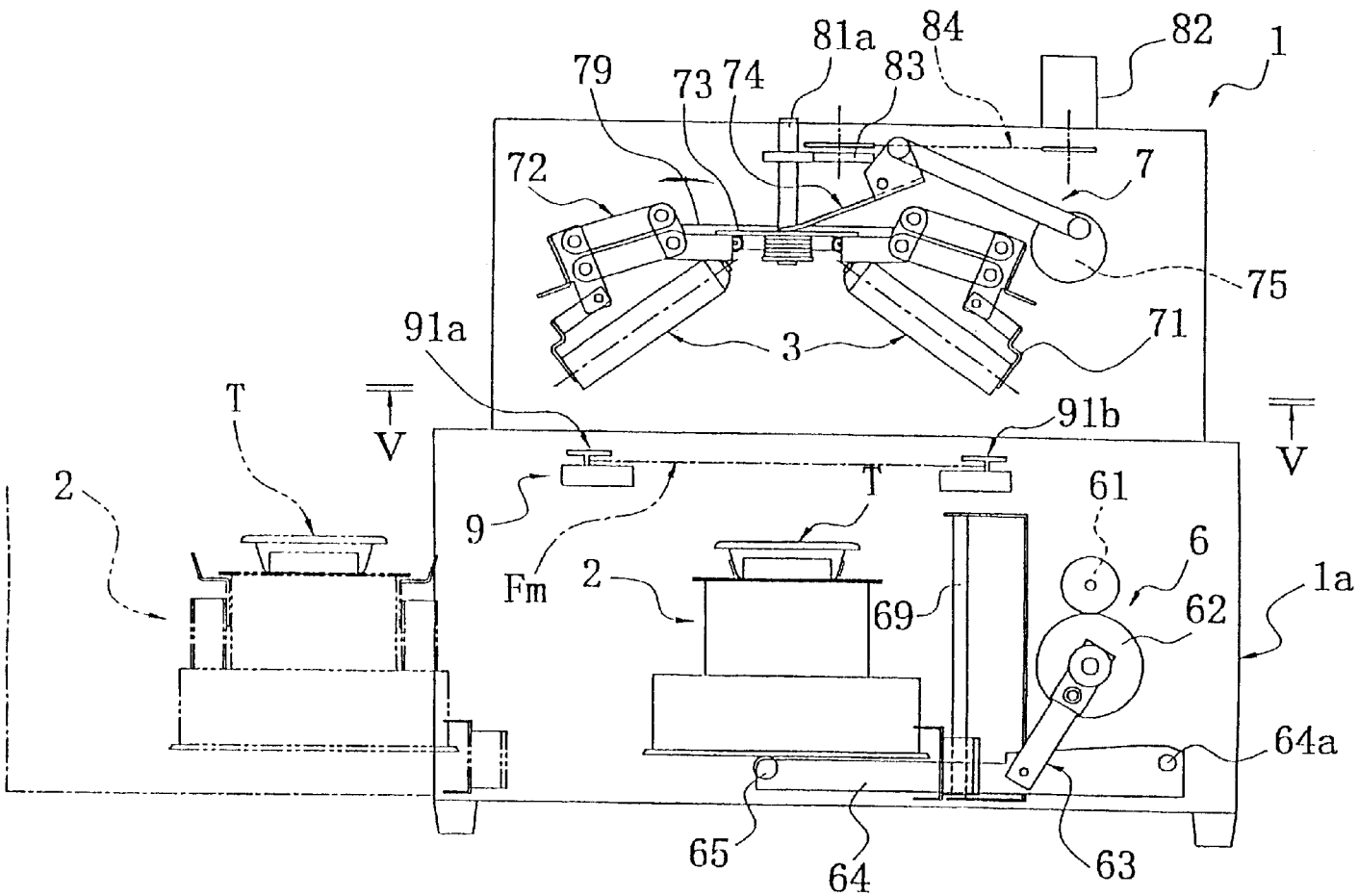
FIG. 2 is a cross-sectional view showing a longitudinal section of the wrapping device.

FIGS. 1 and 2 show a top-seal type wrapping device according to an embodiment of the present invention. The wrapping device 1 shown in FIGS. 1 and 2 is used for covering a top opening o (FIG. 7) of a tray T, in which a fresh food such as meat and fish as well as a processed food such as a precooked meal are arranged, with a stretch film Fm. The wrapping device 1 is also used for welding the stretch film Fm to a flange (a peripheral portion around the opening) f (FIG. 7) of the tray T located around the opening o for sealing the wrapped tray.

[Structure of the Device]

Figure 9:
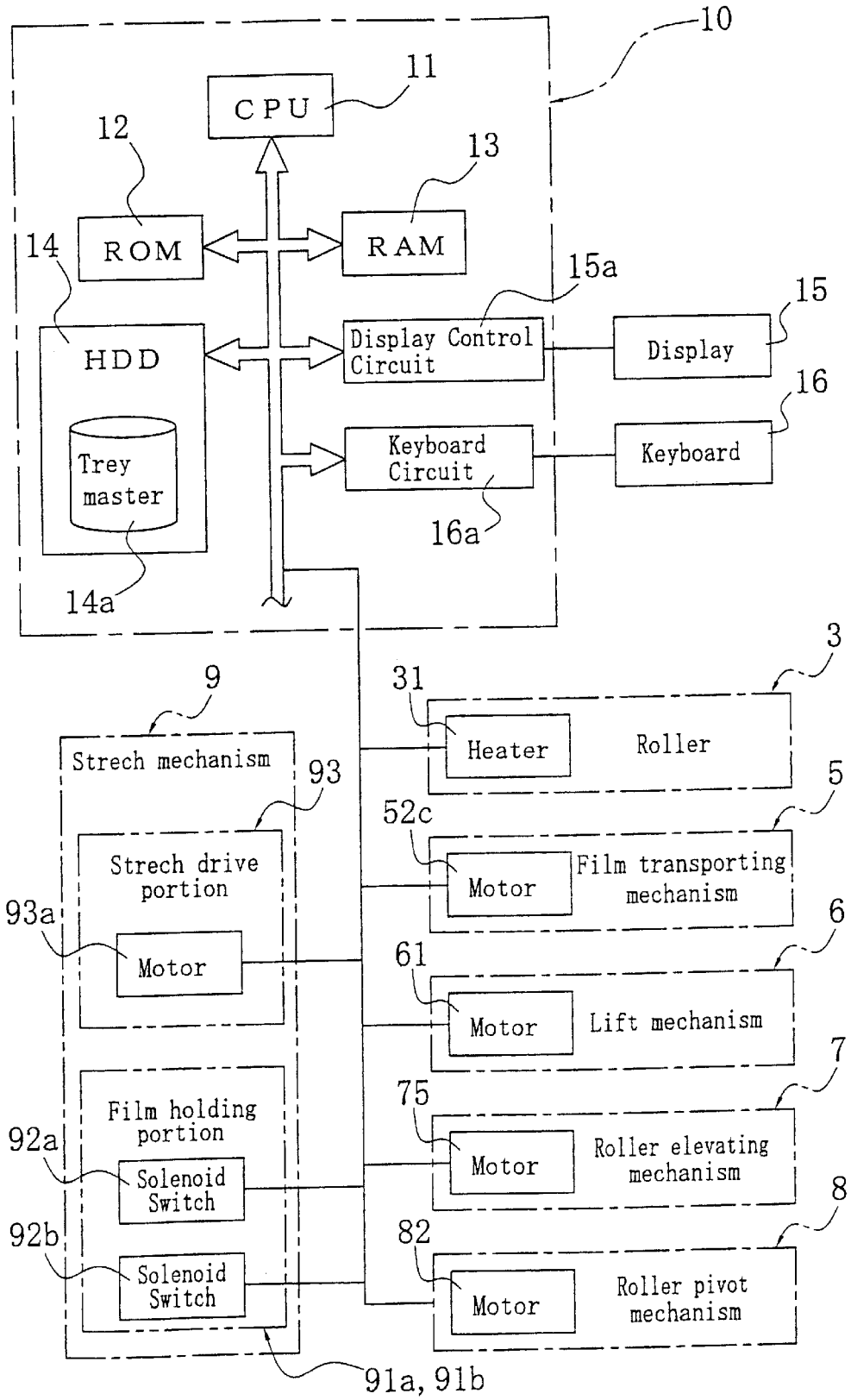
FIG. 9 is a view of a block diagram showing control of the wrapping device.

The wrapping device 1 includes a frame 1*a*, a tray carrying and holding mechanism 2, four rollers 3, a film transporting mechanism 5, a lift mechanism 6, a roller elevating mechanism 7, a roller pivot mechanism 8, a stretch mechanism 9, and a control portion 10 (FIG. 9). The tray carrying and holding mechanism 2 holds the tray T. The four rollers (heating bodies) 3 are arranged above the tray carrying and holding mechanism 2. The film transporting mechanism 5 supplies the stretch film Fm to a position between the tray carrying and holding mechanism 2 and the rollers 3. The lift mechanism 6 vertically moves the tray carrying and holding mechanism 2. The roller elevating mechanism 7 moves the rollers 3 primarily in a vertical direction. The roller pivot mechanism 8 has two pivot shafts 81*a* and 81*b* for pivoting the rollers 3 around each of the pivot shafts 81*a* and 81*b*. The stretch mechanism 9 stretches the stretch film Fm between the tray carrying and holding mechanism 2 and the rollers 3. The control portion 10 (see FIG. 9) controls the respective mechanisms.

[Specific Structures of the Respective Portions]

(Tray Carrying And Holding Mechanism)

The tray carrying and holding mechanism 2 is employed for carrying and holding the tray T thereon, and is moved vertically by the lift mechanism 6. The tray carrying and holding mechanism 2 can be pulled out from a position depicted by a solid line in FIG. 2 to a position depicted by a line with alternating long and two short dashes, and can be pushed in reversely. This horizontal movement is performed manually or by drive means (not shown).

The operation of placing the tray T on the tray carrying and holding mechanism 2 may be performed manually by an operator, or may be automatically performed by a tray transporting device (not shown) or the like.

The specific structures of the tray carrying and holding mechanism 2 will be described later.

(Rollers)

Each roller 3 is a cylindrical member, and is rotatably supported by a roller support 71 of the roller elevating mechanism 7, which will be described later. The roller 3 is provided at its surface with a layer softer than the other portions for reducing frictional resistance with respect to the stretch film Fm. More specifically, the surface of the roller 3 is made of an elastic material such as resin or synthetic rubber so that the stretch film Fm can be closely pressed against the flange f even when fine irregularities are present on the surface of the flange f of the tray T.

Figure 5:
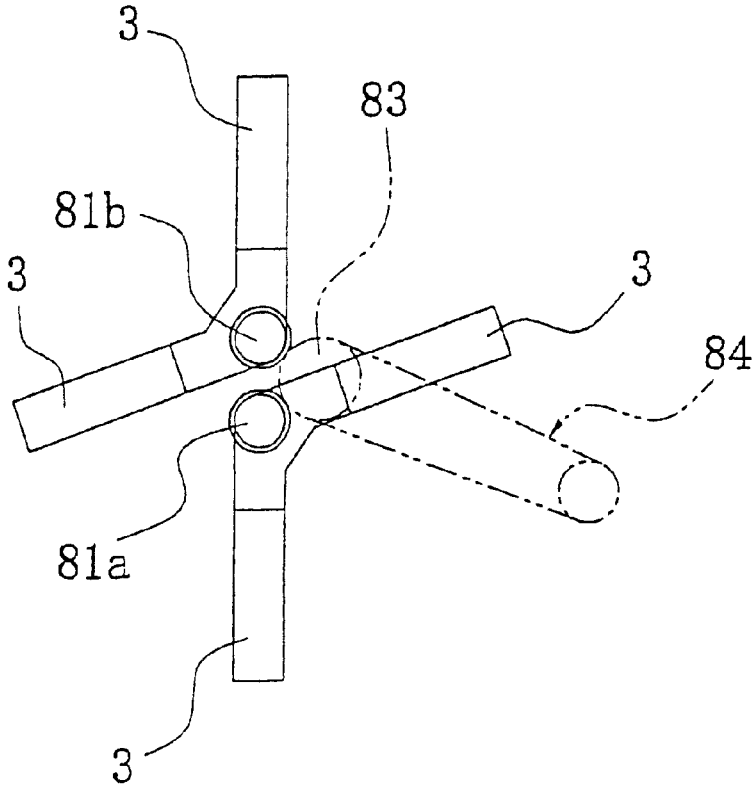
FIG. 5 is a plan view showing an arrangement of rollers of the wrapping device.

Two rollers 3 are provided for each of the pivot shafts 81*a* and 81*b* of the roller pivot mechanism 8, which will be described later, as shown in FIG. 5. FIG. 5 shows an arrangement of the rollers 3 viewed from the lower side. In a plan view, the rollers 3 are arranged as shown in FIG. 5, and the two rollers 3 attached to each of the pivot shafts 81*a* and 81*b* form an angle of about 110 degrees.

When viewed as shown in FIGS. 1 and 2, these rollers 3 supported by the roller supports 71 are inclined with respect to the horizontal top surface of the tray T. Owing to this inclination, the end of each roller 3 near the pivot shaft 81*a* or 81*b* is located at a higher level than its opposing end.

The roller 3 is internally provided with a heater 31 (FIG. 9) for heating the roller 3. Specifications of this heater are appropriately selected in accordance with the materials of the tray T and the stretch film Fm and in view of the fact that an energy must be supplied for restoring the heat quantity, which is lost in the sealing operation, within a short time.

(Film Transporting Mechanism)

The film transporting mechanism 5 is employed for paying out the stretch film Fm to a position between the tray carrying and holding mechanism 2 in the lowered position and the rollers 3. The film transporting mechanism 5 is also employed for winding up the stretch film Fm, which is partially and thermally cut out for the sealing operation. The film transporting mechanism 5 is formed of, as shown in FIG. 1, a film set portion 51, a film winding portion 53, and a film transporting portion 52. The film set portion 51, the film transporting portion 52, and the film winding portion 53 are provided on the frame 1*a*.

The film set portion 51 is formed of members for rotatably supporting a film roll R of the stretch film Fm, and holds the film roll R to form the source of the stretch film Fm. The film set portion 51 has a vertically movable core support member 51*a* and a support roller 51*b* supporting a lower side of the film roll R in an obliquely upward direction. The film roll R is supported by the core support member 51*a* and the support roller 51*b* as well as a payoff roller 52*a* of the film transporting portion 52, which will be described later (see FIG. 1).

The film winding portion 53 is provided for winding up the remaining stretch film Fm, which is partially cut out for wrapping the tray T in the top-seal manner, and has a winding shaft 53*a*. The winding shaft 53*a* is driven via a belt 53*b* by an electric motor 52C, which will be described later. The specific structure of the winding shaft 53*a* will be described later.

The film transporting portion 52 includes the payoff roller 52*a*, a motor 52*c* for driving the payoff roller 52*a* via a belt 52*b*, and a film support roller 52*d*. The stretch film Fm pulled out from the film roll R is sent toward the film winding portion 53 by the payoff roller 52*a*. Since the motor 52*c* drives not only the payoff roller 52*a* but also the winding shaft 53*a*, the stretch film Fm is payed out from the film roll R, and is wound around the winding shaft 53*a*. The rotation speed of the winding shaft 53*a* is higher than the rotation speed of the payoff roller 52*a*. Therefore, the stretch film Fm is subjected to a tension in the transporting direction. Thereby, the film can be transported without slack.

The payoff roller 52*a* has a grip with respect to the stretch film Fm, and can pay out the stretch film Fm to a predetermined amount without slip. More specifically, the payoff roller 52*a* has a mirror-finished surface. A one-way clutch (not shown) for preventing reverse rotation of the payoff roller 52*a* is arranged.

The payoff roller 52*a* and the support roller 51*b* are arranged symmetrically with respect to the core support member 51*a*, as shown in FIG. 1. A distance between the payoff roller 52*a* and the support roller 51*b* is smaller than a diameter of the core member of the film roll R so that the film roll R may not fall through a space between the rollers 52*a* and 51*b*.

The film support roller 52*d* is arranged near the film winding portion 53, and has a top surface at the same level as the lowest surface of the payoff roller 52*a* (see FIG. 1). Therefore, a portion of the stretch film Fm, which is being transported between the payoff roller 52*a* and the film support roller 52*d*, is kept horizontal.

(Stretch Mechanism)

The stretch mechanism 9 holds the stretch film Fm extending from the film set portion 51 to the film winding portion 53. More specifically, the stretch mechanism 9 holds the opposite sides or edges of the horizontal portion of the stretch film Fm located between the payoff roller 52*a* and the film support roller 52*d* for stretching widthwise (i.e., laterally in FIG. 2) the stretch film Fm. This stretch mechanism 9 has a pair of film holding portions 91*a* and 91*b* extending in the film transporting direction, and a stretch drive portion 93 (see FIG. 9) for moving the film holding portions 91*a* and 91*b* in a direction (i.e., laterally in FIG. 2) perpendicular to the film transporting direction.

The film holding portions 91*a* and 91*b* are configured to pinch and hold vertically opposite sides of the stretch film FM, and are turned on/off by solenoids 92*a* and 92*b* (see FIG. 9), respectively. A portion of each film holding portion 91*a* and 91*b*, which is in contact with the upper side of the stretch film Fm, is provided with pads p1–p8 made of rubber or resin and having a large friction coefficient for preventing slip of the film holding portion 91*a* or 91*b* on the stretch film Fm. More specifically, each of the film holding portions 91*a* and 91*b* is configured to pitch and hold the stretch film Fm between the upper pads p1–p8 and a lower member 94.

The stretch drive portion 93 is formed of an electric motor 93*a* (see FIG. 9), guide rails, sprockets, chains, and others. The stretch drive portion 93 moves the film holding portions 91*a* and 91*b* laterally in FIG. 2 in accordance with an instruction sent from the control portion 10.

(Lift Mechanism)

Figure 3:
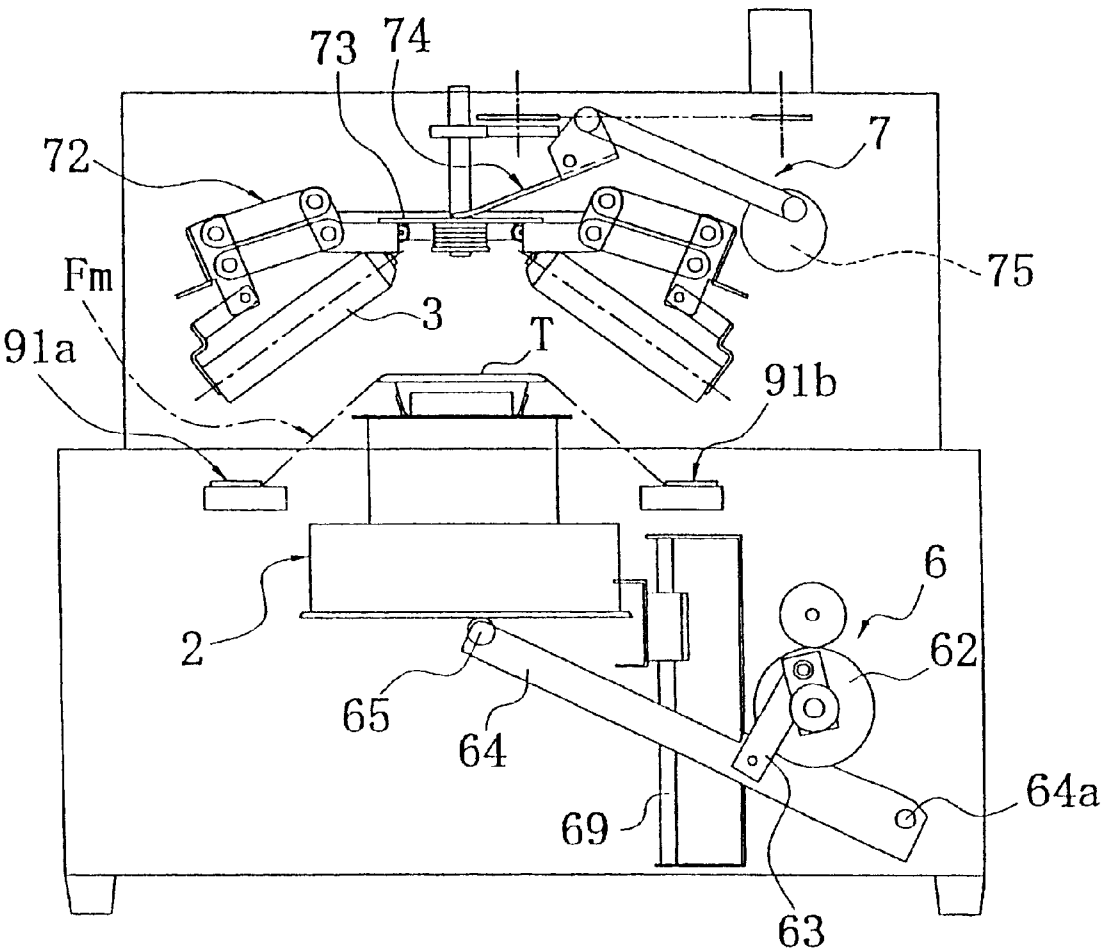
FIG. 3 is a cross-sectional view showing an operation of the wrapping device.

The lift mechanism 6 is provided for pushing up the tray carrying and holding mechanism 2 that holds the tray T against the stretch film Fm, as shown in FIG. 3. As seen in FIGS. 2 and 3, the lift mechanism 6 is formed of a drive motor 61, a large gear 62 carried on the frame 1*a*, a link member 63, a lever 64 having one end pivotably attached to a fulcrum 64*a* on the frame 1*a*, a circular plate 65 rotatably attached to the other end of the lever 64, and others.

When the drive motor 61 operates, it rotates the large gear 62 via a gear fixed to the motor shaft. Thereby, the link member 63 moves the level 64 to pivot around the fulcrum 64*a*. Thereby, the tray carrying and holding mechanism 2 having the lower surface, which is supported by the circular member 65, moves upward or downward (see FIGS. 2 and 3). The tray carrying and holding mechanism 2 is guided by vertical guide rails 69 so that it moves in the vertical direction in accordance with the operation of the lift mechanism 6.

(Roller Elevating Mechanism)

The roller elevating mechanism 7 is employed for changing the vertical position of the rollers 3. The roller elevating mechanism 7 is formed of, as shown in FIG. 1, roller supports 71, link mechanisms 72, a pushing plate 73, a lever mechanism 74, and an electric motor 75. The roller supports axes of the rollers 3. The lever mechanism 74 applies a downward force to the pushing plate 73. The electric motor 75 operates the lever mechanism 74.

The roller support 71 supports the axes of the rollers 3, which are inclined in the side view as shown in FIGS. 1 and 2. A rotation axis of the roller 3 is depicted by alternate long and short dash lines in FIGS. 1 and 2. The link mechanism 72 has an end supporting the roller support portion 71 via a pin, and has another end that can be pushed down by the pushing plate 73. When the other end of the link mechanism 72 is pushed down by the pushing plate 73, the end of the link mechanism 72 remote from the pushed end occupies a raised position so that the roller support 71 and the rollers 3 occupy raised positions, respectively. When the pushing plate 73 does not apply force to the link mechanisms 72, the other end of the link mechanism 72 lowers, e.g., owing to the weights of the roller supports 71 and the rollers 3 (see FIGS. 2 and 4).

Figure 4:
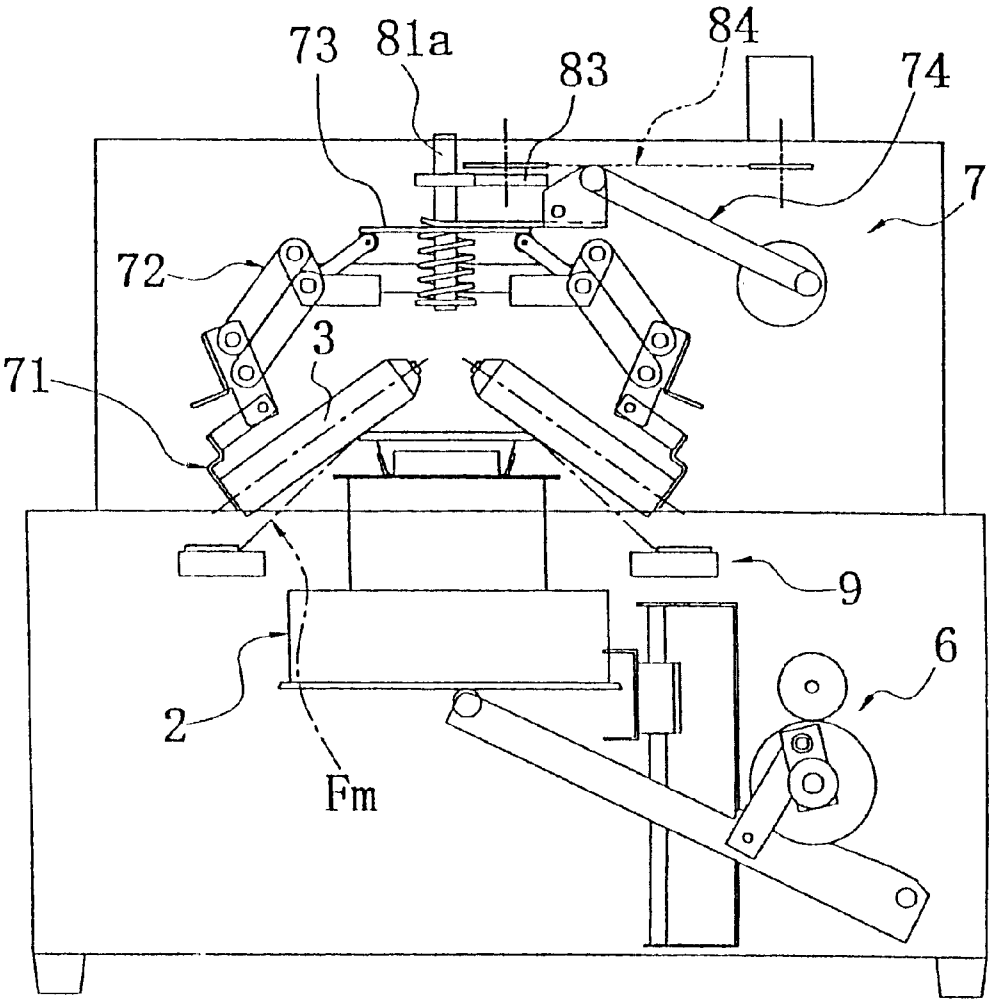
FIG. 4 is a cross-sectional view showing an operation of the wrapping device.

The pushing plate 73 receives a downward force from the lever mechanism 74 operated by the motor 75. As shown in FIGS. 2 and 4, the outer peripheral portion of the pushing plate 73 is placed on rollers each supported by the other end of the link mechanism 72.

(Roller Pivot Mechanism)

The roller pivot mechanism 8 (FIGS. 1 and 2) is provided for pivoting the roller 3 as well as the roller supports 71 and the link mechanisms 72 through a predetermined angle when performing the wrapping. This roller pivot mechanism 8 is primarily formed of a first pivot shaft 81*a*, a second pivot shaft 81*b*, and an electric motor 82 for turning the pivot shafts 81*a* and 81*b*.

The first pivot shaft 81*a* has a lower end fixed to a base member 79, which supports the two link mechanisms 72, and has an upper end, which is engaged with a main gear 83 via another gear. The main gear 83 is coupled to the motor 82 via pulleys and a belt 84, and is rotated by the motor 82.

The second pivot shaft 81*b* has a lower end fixed to a base member 79, which supports the other two link mechanisms 72, and is different from the base member 79 attached to the first pivot shaft 81*a*. The upper end of the second pivot shaft 81*b* is engaged with the main gear 83 via another gear (see FIG. 5).

Figure 6:
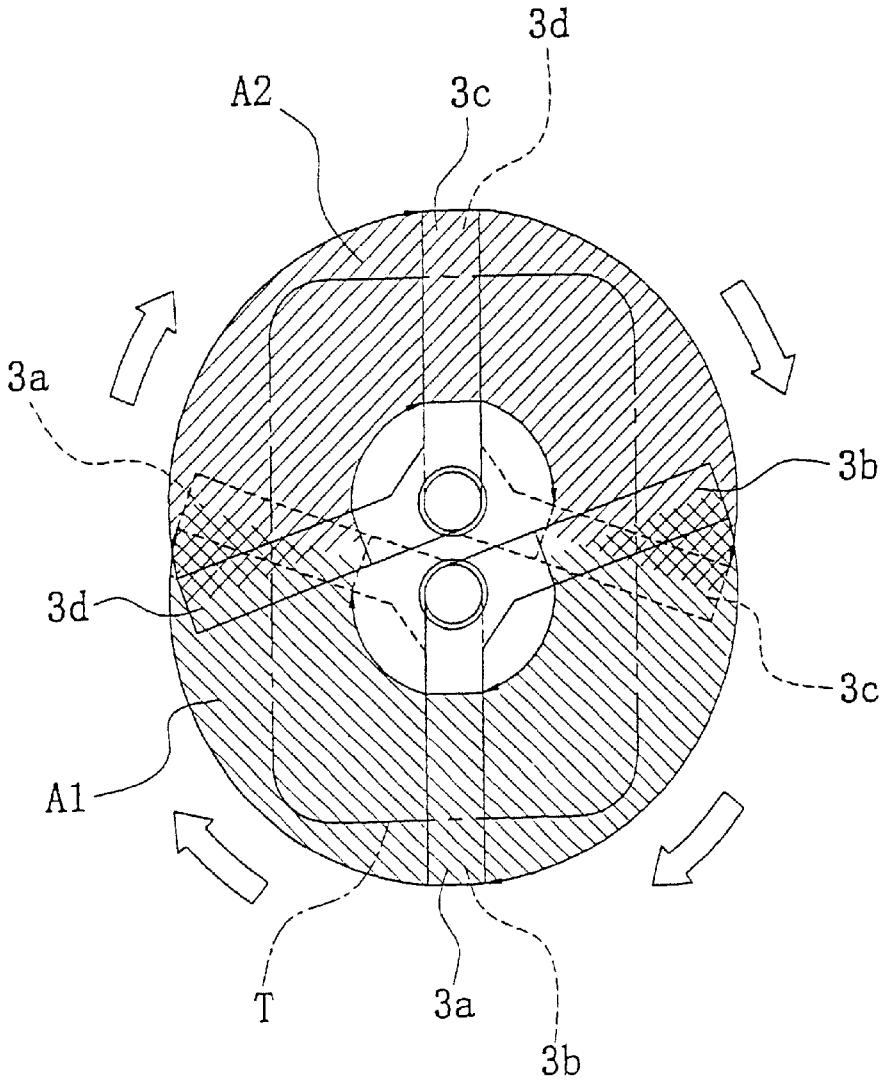
FIG. 6 is a plan view showing pivoting paths of the rollers of the wrapping device.

When the control portion 10 (FIG. 9) controls the motor 82 to turn the pivot shafts 81*a* and 81*b* by a predetermined angle, each roller 3 pivots a predetermined angle around the first or second pivot shaft 81*a* or 81*b* (see FIG. 6). In FIG. 6, the rollers 3 coupled to the first pivot shaft 81*a* are represented as the rollers 3*a* and 3*b*, and the rollers 3 coupled to the second pivot shaft 81*b* are represented as the rollers 3*c* and 3*d*. In FIG. 6, the position of the roller 3 before the pivoting is depicted by solid line, and the position of the roller 3 after the pivoting is depicted by dotted line.

(Control Portion)

As shown in FIG. 9, the control portion 10 includes a CPU 11 as its main control unit, and also includes a ROM 12 and a RAM 13 as main storages controlled by the CPU 11. The control portion 10 includes circuits such as a display control circuit 15*a* for controlling data display on a display 15 for an operator, and a keyboard circuit 16*a* for taking in data entered by the operator through a keyboard 16.

The control portion 10 further includes a hard disk 14 storing a tray master file 14*a*. The tray master file 14*a* includes data such as sizes, materials, forms, and others of the trays corresponding to respective tray numbers. In the RAM 13, a data region is formed for storing the tray information called up from the tray master file 14*a*.

The CPU 11, ROM 12, RAM 13, HDD 14, and circuits 15*a* and 16*a* are mutually connected via bus lines such as an address bus and a data bus.

The control portion 10 is connected to drive means such as electric motors of the various mechanisms as well as the heater 31 for controlling the operations thereof, as shown in FIG. 9.

[Operation Control of the Wrapping Device]

(Whole Control)

When the tray carrying and holding mechanism 2 is in the pulled-out position indicated by alternate long and two short dashes line in FIG. 2, the tray T containing the contents or wrapping target such as food is placed on the tray carrying and holding mechanism 2. Then the tray carrying and holding mechanism 2 is moved horizontally to a position under the rollers 3 by a manual operation or the drive means (not shown).

When the tray carrying and holding mechanism 2 is moved to the position under the roller 3, the tray carrying and holding mechanism 2 centers the tray T, and holds the four sides of the tray T. This operation of the tray carrying and holding mechanism 2 will be described later.

The control portion 10 calculates the amount of stretch film Fm to be payed out by the film transporting mechanism 5 depending on the tray. More specifically, the control portion 10 calls up the size and material of the tray stored in the tray master file 14*a* in accordance with the tray number, which is entered via the keyboard 16, and calculates the amount of the stretch film Fm to be payed out. This payed-out amount of the stretch film Fm, and thus the transportation amount of the film will be described later.

When the film transporting mechanism 5 pays out the stretch film Fm, the control portion 10 operates the stretch mechanism 9 to stretch the stretch film Fm widthwise (laterally in FIG. 2). Thereby, the widthwise tension is applied to the stretch film Fm, and wrinkles are prevented.

Then, the control portion 10 operates the lift mechanism 6 to lift the tray carrying and holding mechanism 2 holding the tray T. Thereby, the tray T pushes up the stretch film Fm, and stops (FIG. 3).

Then, the control portion 10 controls the motor 75 to release the downward biasing, which is applied by the lever mechanism 74 to the pushing plate 73, and thereby allows a free motion of the link mechanisms 72. Thereby, the rollers 3 lower and come into contact with the tray T owing to their weights and others (see FIG. 4). These rollers 3 are independent of each other so that the respective rollers 3 are in contact with the tray T with substantially the same pressure.

Then, the control portion 10 controls the motor 82 to turn the pivot shafts 81*a* and 81*b* by the predetermined angle. In this embodiment, this predetermined angle is set to 110 degrees so that the whole flange f of the tray T can be contacted by the rollers 3*a*–3*d* (see FIG. 6).

As the rollers 3 pivot around the pivot shafts 81*a* and 81*b*, the rollers 3 roll over the stretch film Fm on the tray T to weld the flange f of the tray T to the stretch film Fm.

Figure 7:
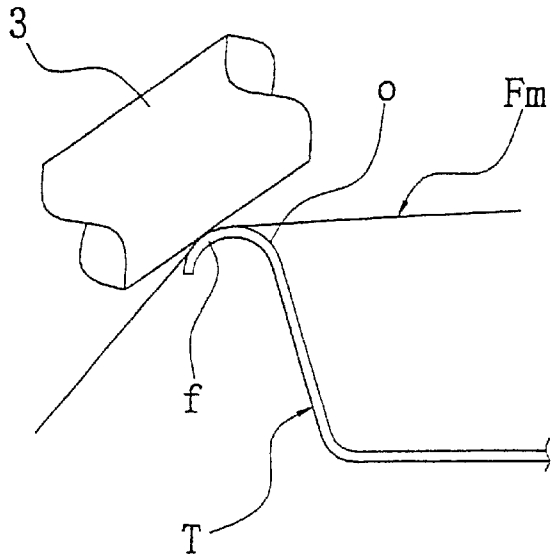
FIG. 7 is a view showing on an enlarged scale, structures of and near a flange of a tray in contact with one of the roller.
Figure 8:
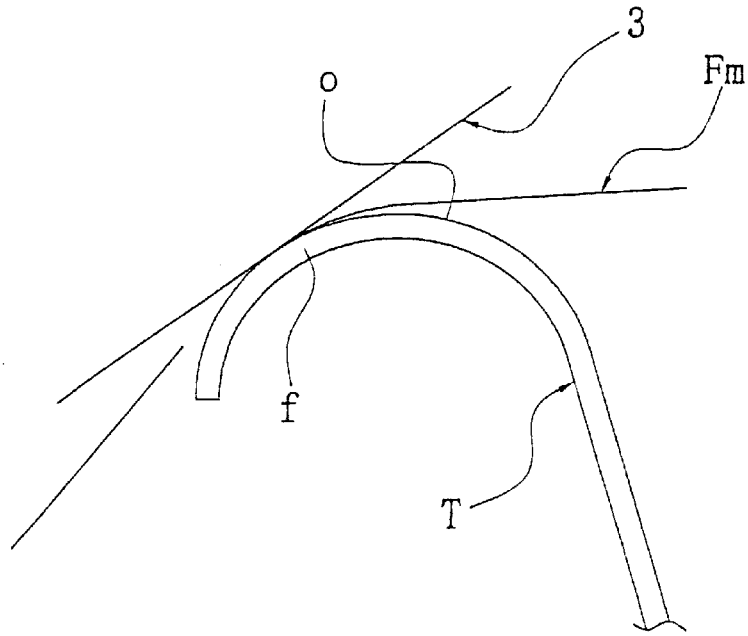
FIG. 8 is a view showing on an enlarged scale, structures of and near the flange of the tray during welding of a film.

When the rollers 3 move along the periphery of the tray T, they are in the state shown in FIG. 7, which shows, on an enlarged scale, a portion of the roller 3 at and near a contact position. The tray T is in such a state that the opening o is covered with the stretch film Fm. The stretch film Fm is pressed against the flange f of the tray T. The roller 3 is in contact with the portion of the stretch film Fm, which is in contact with the flange f, in an oblique direction, and applies heat and force thereto. The heat and force weld the stretch film Fm to the flange f. In this operation, the heat and force are concentrated on the edge portion of the tray T, which is the outer side of the top portion of the flange f in contact with the roller 3 in this embodiment. Thus, the stretch film Fm melts and is cut off at the edge portion of the tray T (see FIG. 8). The control portion 10 pivots the rollers 3 at such a speed that the stretch film Fm and the flange f are welded together, and the stretch film Fm is thermally cut off along the outer side of the welded portion.

When the rollers 3 complete the welding of the stretch film Fm to the tray T, the roller 3 is pulled up, and the tray T is lowered. Then, the sealed tray T is removed from the tray carrying and holding mechanism 2 in the pulled-out position, and then the next cycle starts. When the tray carrying and holding mechanism 2 is pulled out from the position depicted by the solid line in FIG. 2 (i.e., under the roller 3) to the position depicted by the alternate long and two short dashes line, the tray T is no longer held, as will be described later.

When the operation moves to the next cycle, the stretch film Fm, which was welded and cut out partially and thermally for wrapping the tray T, is wound around the winding shaft 53*a* (FIG. 1). In this operation, the motor 52*c* rotates the film support roller 52*d* and the payoff roller 52*a* so that the pay-out of the stretch film Fm (i.e., supply of the stretch film Fm to the position under the rollers 3) is performed for the next cycle simultaneously with the winding.

The stretch film Fm has a width exceeding the width of the tray T at least after it is stretched by the stretch mechanism 9. Therefore, the stretch film Fm can maintain the continuous structure even after the sealed wrapping of the tray T (cutting out of the stretch film Fm), and a disadvantage does not occur such that the film cannot be wound around the film winding portion 53.

(Control of Stretch Mechanism)

The control portion 10 does not operate the stretch mechanism 9 during transportation of the stretch film Fm by the film transporting mechanism 5. However, the control portion 10 operates the stretch mechanism 9 when welding the stretch film Fm to the tray T.

When welding the stretch film Fm to the tray T, the control portion 10 operates the stretch mechanism 9 in four stages. This control of the stretch mechanism 9 will now be described with reference to FIGS. 10 and 11.

Figure 10:
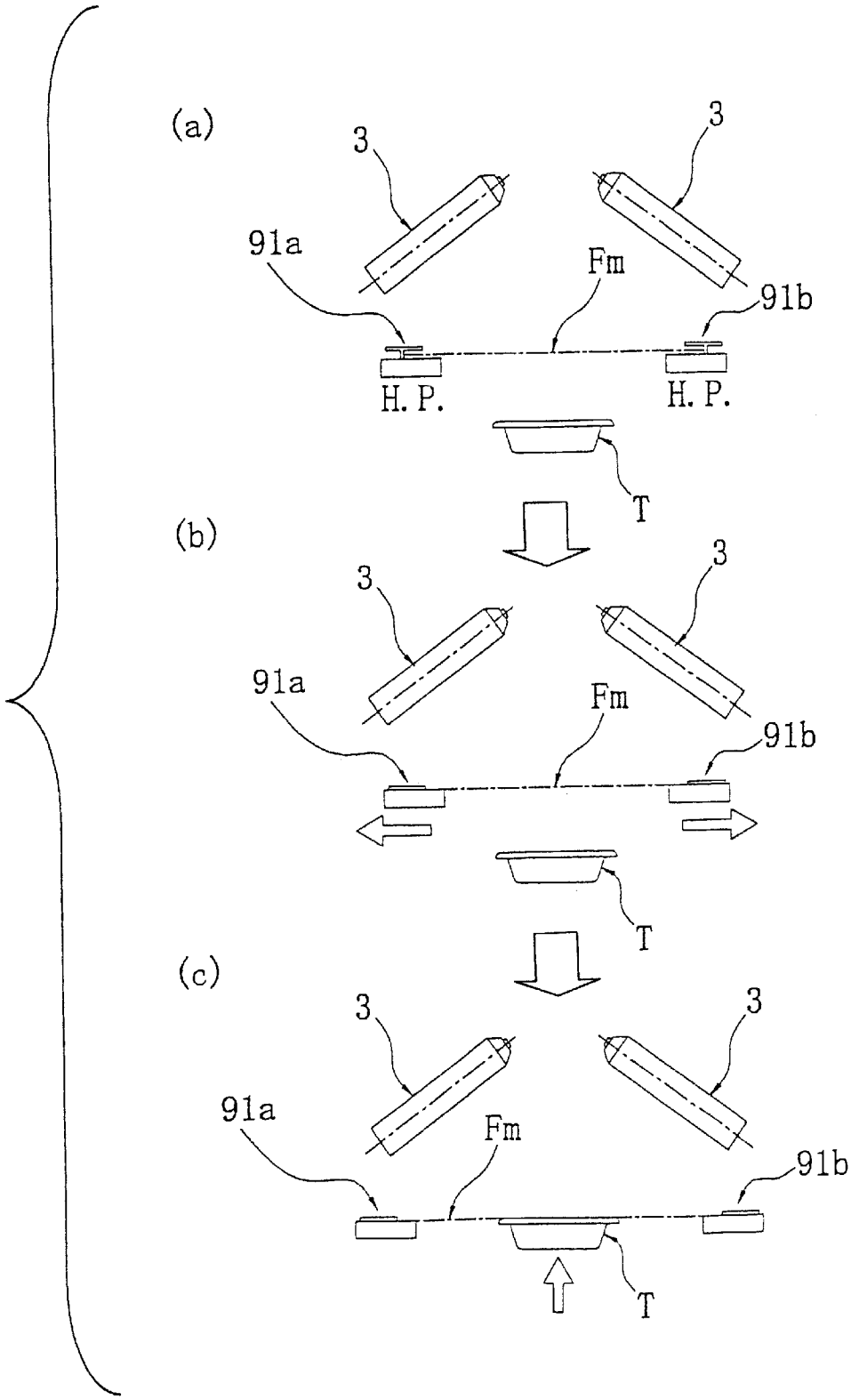
FIG. 10 is a view showing an operation of a stretch mechanism.

In the first stage, the film holding portions 91*a* and 91*b*, which are in a home position H. P. shown in FIG. 10(*a*), hold the laterally opposite sides of the stretch film Fm, and then are moved outward to stretch the stretch film Fm as shown in FIG. 10(*b*). Thus, the stretch mechanism 9 operates to stretch the stretch film Fm before pushing up the tray T against the stretch film Fm by the lift mechanism 6. In this manner, the stretch film Fm is stretched by an amount, which will be referred to as a prestretch amount, and will be described later in greater detail.

Figure 11:
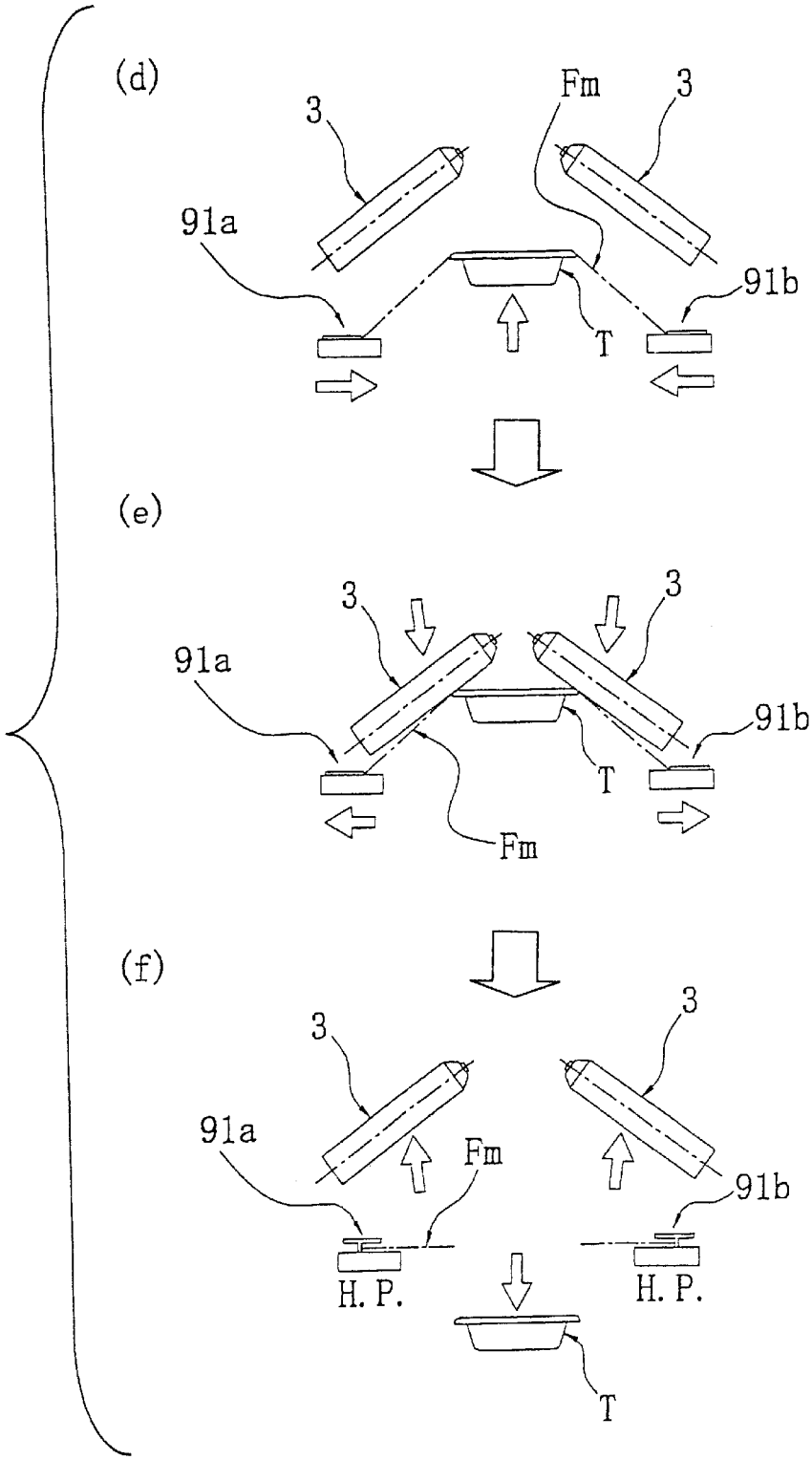
FIG. 11 is a view showing an operation of the stretch mechanism.
Figure 12A:
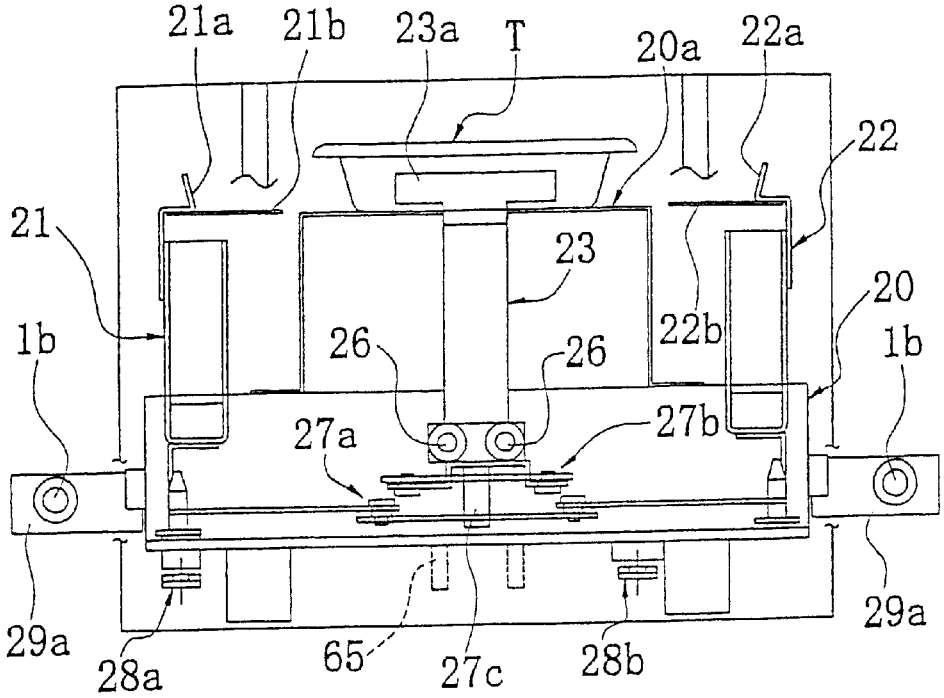
FIG. 12*a* is a view showing an arrangement of members on a front surface of a tray carrying and holding mechanism in a pulled-out position.
Figure 12B:
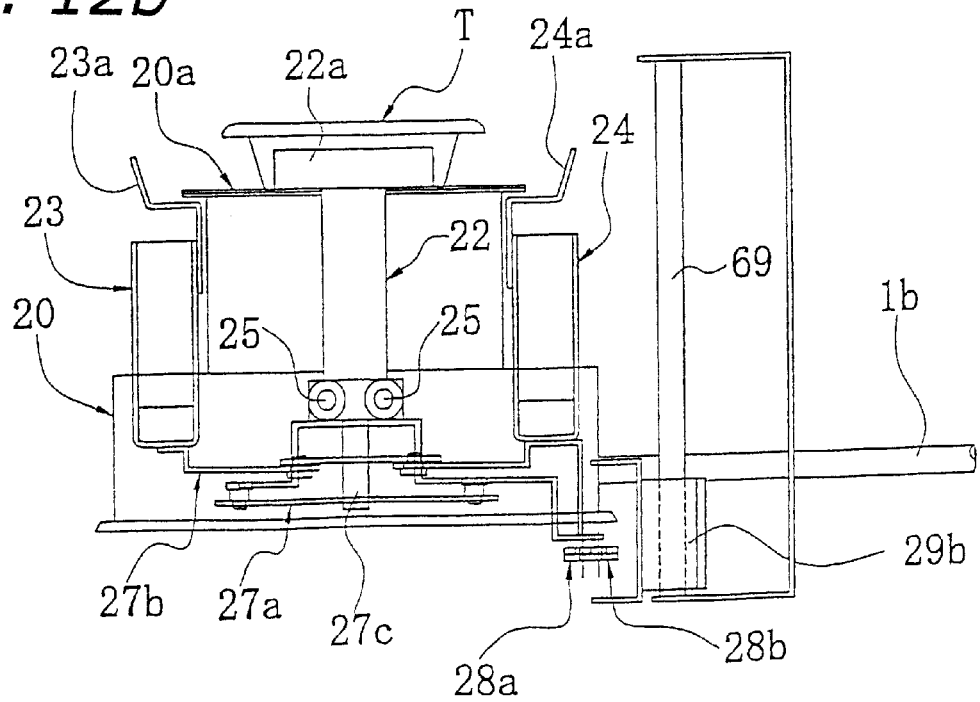
FIG. 12*b* is a view showing an arrangement of members on a side surface of the tray carrying and holding mechanism of FIG. 12*a;*
Figure 13A:
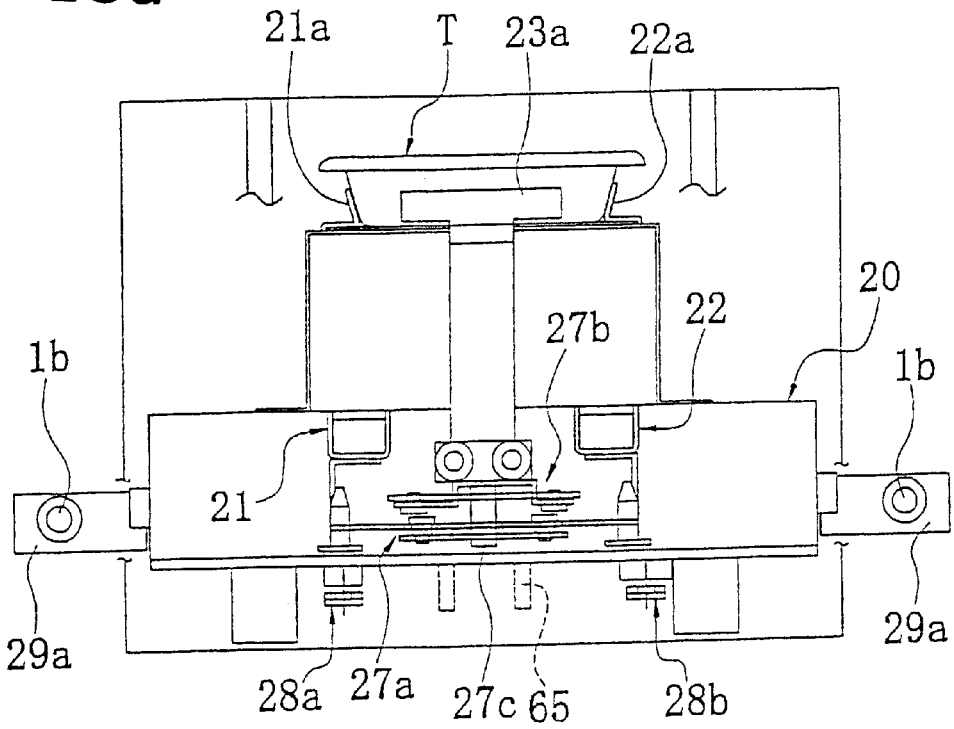
FIG. 13*a* is a view showing an arrangement of the members on the front surface of the tray carrying and holding mechanism in a pushed-in position.
Figure 13B:
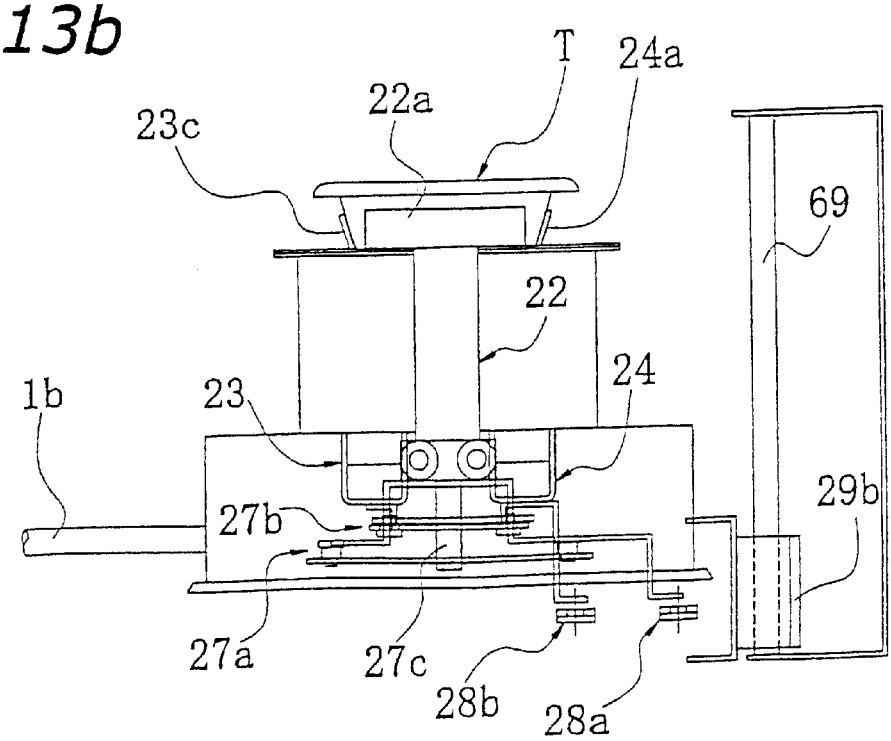
FIG. 13*b* is a view showing an arrangement of the members on side surface of the tray carrying and hold mechanism of FIG. 13*a;*
Figure 14:
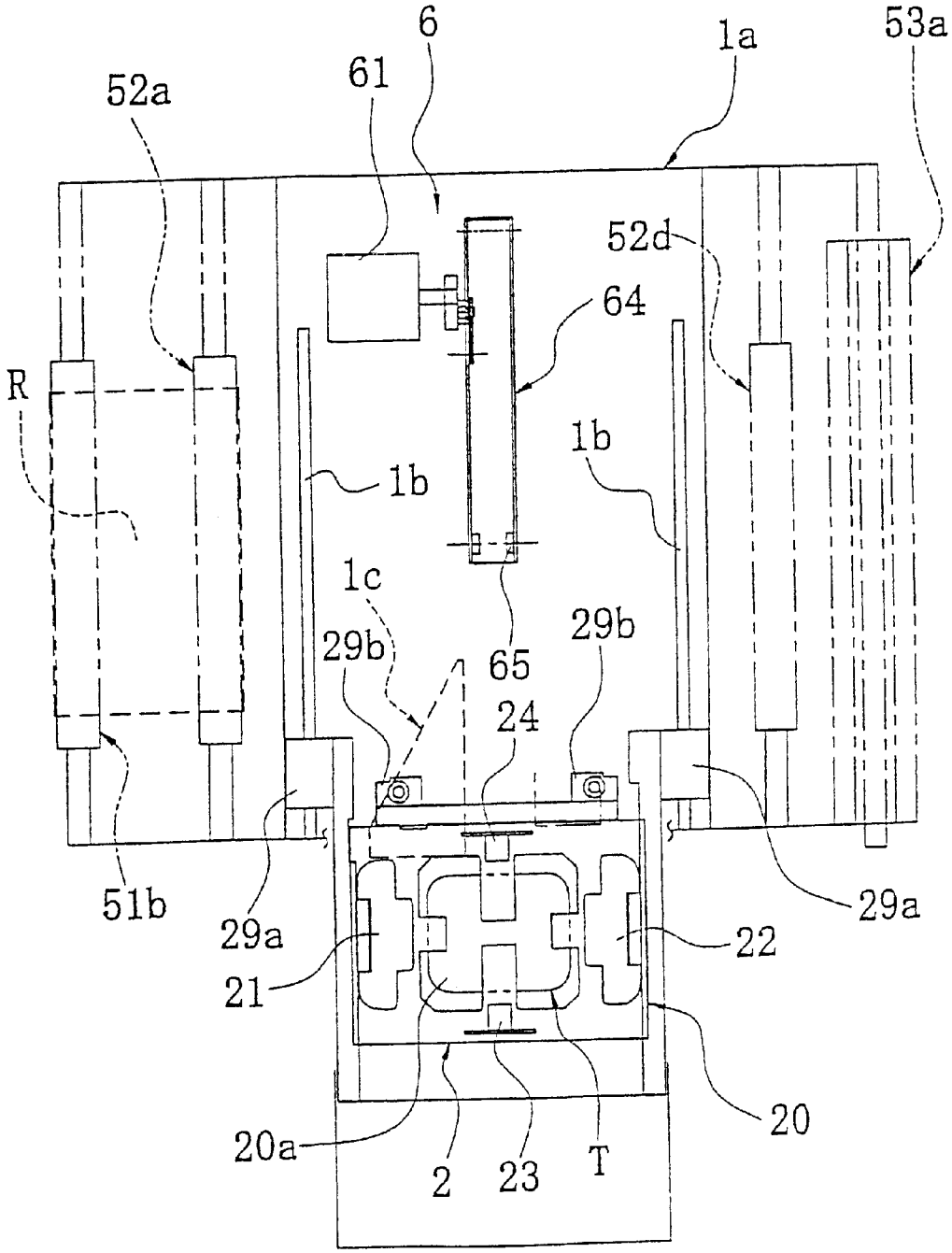
FIG. 14 is a plan view showing the members arranged when the tray carrying and holding mechanism is pulled out.
Figure 15:
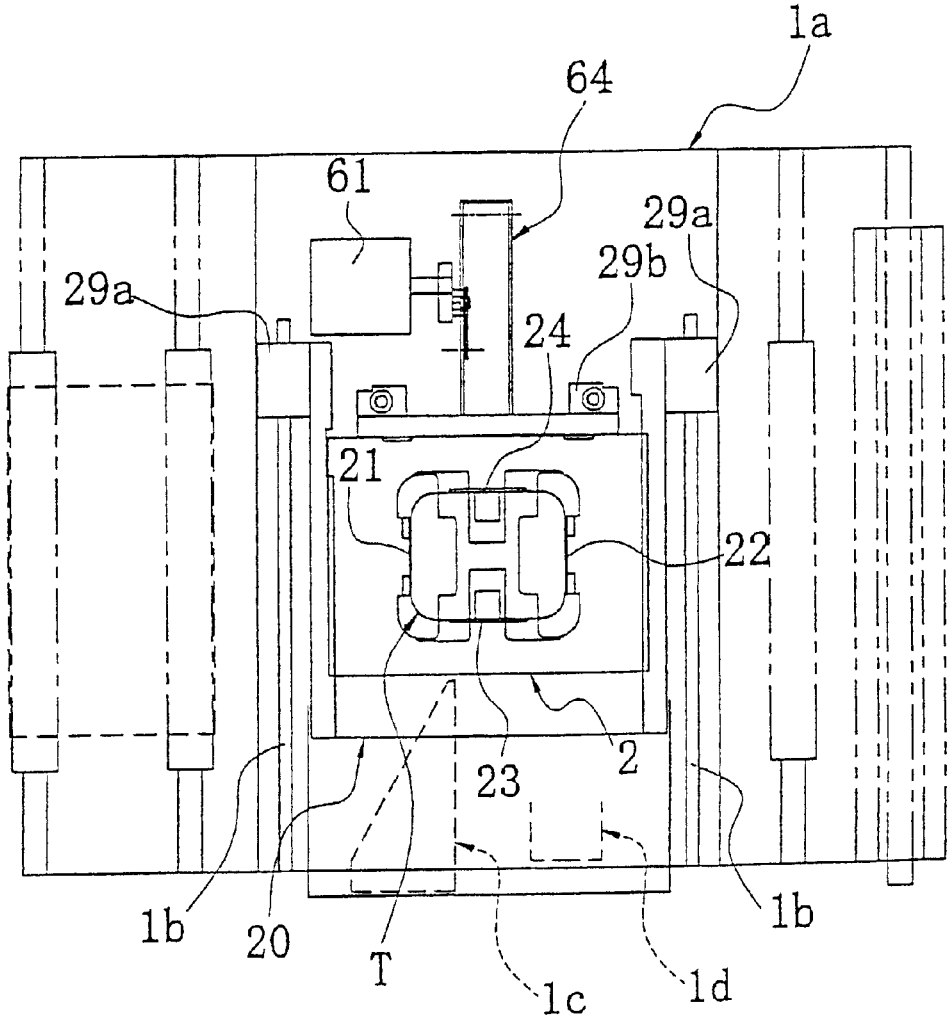

In the second stage, the stretch mechanism 9 operates to reduce the stretching force or tension applied to the stretch film Fm immediately after the tray T, which is being lifted by the lift mechanism 6, comes into contact with the stretch film Fm. Thus, both the film holding portions 91*a* and 91*b* are moved inward to reduce the tension of the stretch film Fm for a period after the tray T comes into contact with the stretch film Fm as shown in FIG. 10(*c*) and before the tray T reaches the upper limit as shown in FIG. 11(*d*). However, a certain tension is kept in the stretch film Fm even in the state where the tray T is in the highest position shown in FIG. 11(*d*).

In the third stage, the rollers 3 weld the stretch film Fm to the tray T as shown in FIG. 11(*e*), and then the opposite film holding portions 91*a* and 91*b* are moved outward to stretch the stretch film Fm.

In the fourth stage, the welding of the stretch film Fm to the tray T as well as the thermal cutting of the stretch film Fm are completed so that the rollers 3 are moved upward, and the tray T is lowered. Thereafter, the opposite film holding portions 91*a* and 91*b* of the stretch mechanism 9 return to the home position.

[Specific Structure of the Tray Carrying And Holding Mechanism]

The specific structure of the tray carrying and holding mechanism 2 will now be described.

As shown in FIGS. 12–19, the tray carrying and holding mechanism 2 is primarily formed of a casing 20, first to fourth tray holding members 21–24, lateral guide shafts 25, longitudinal guide shafts 26, link mechanisms 27*a* and 27*b*, coil springs 27*d* and 27*e*, first and second rollers 28*a* and 28*b*, and vertically movable guide members 29*b*.

Figure 16:
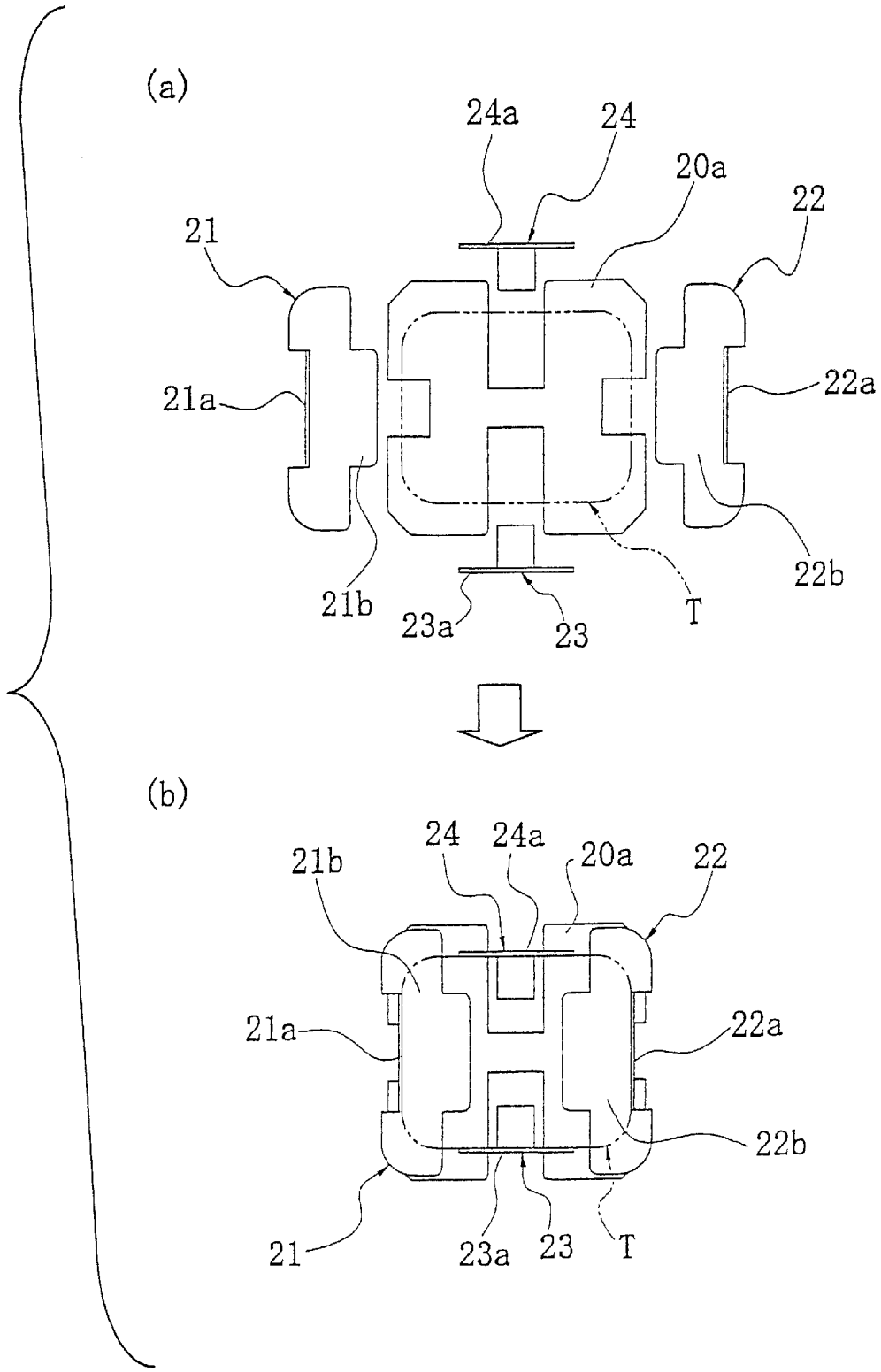
FIG. 16 is a plan view showing an operation of tray holding members.
Figure 17:
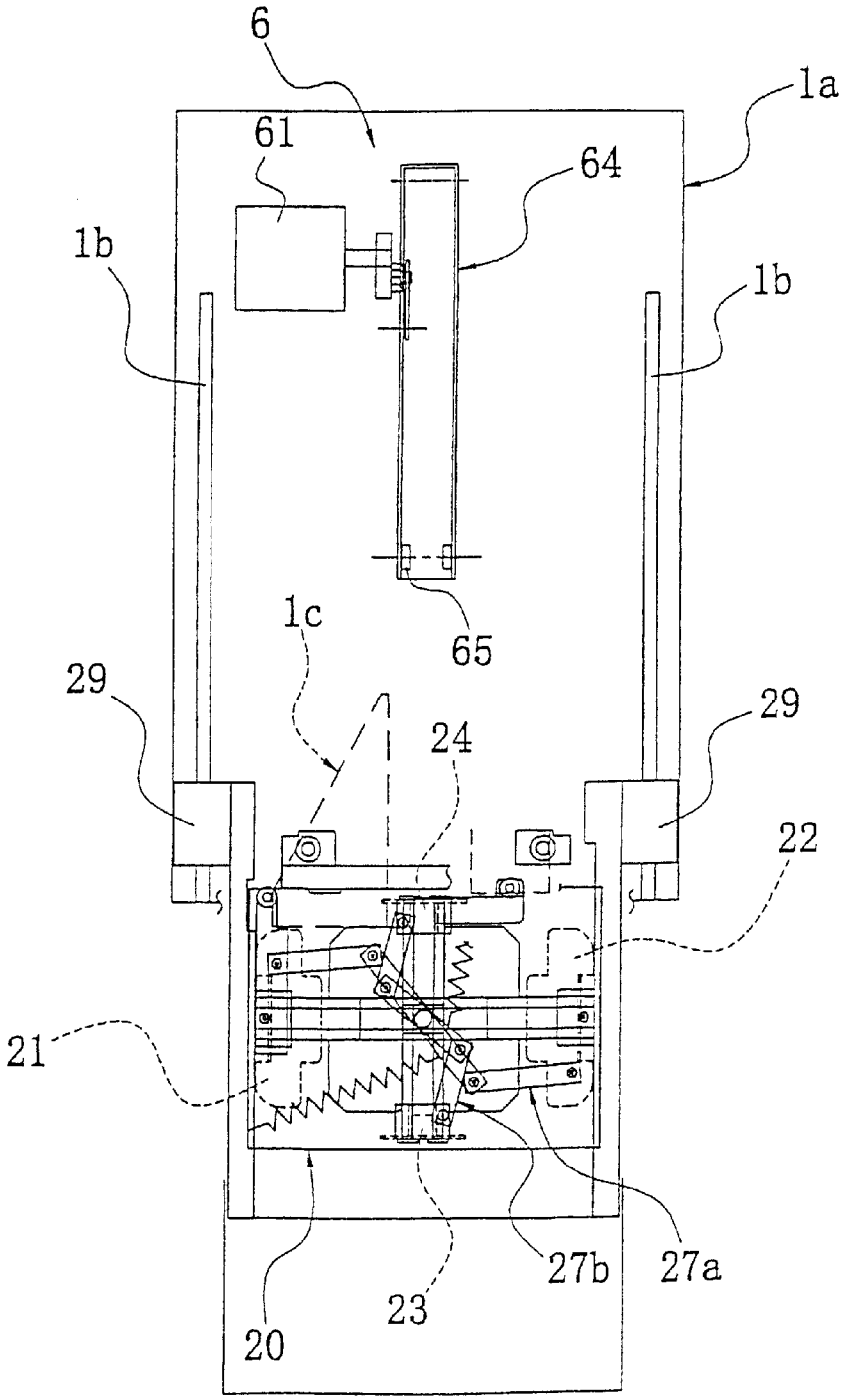
FIG. 17 is a plan view showing the arrangement of the members of a link mechanism and others of the tray carrying and holding mechanism in the pulled-out state.
Figure 18:
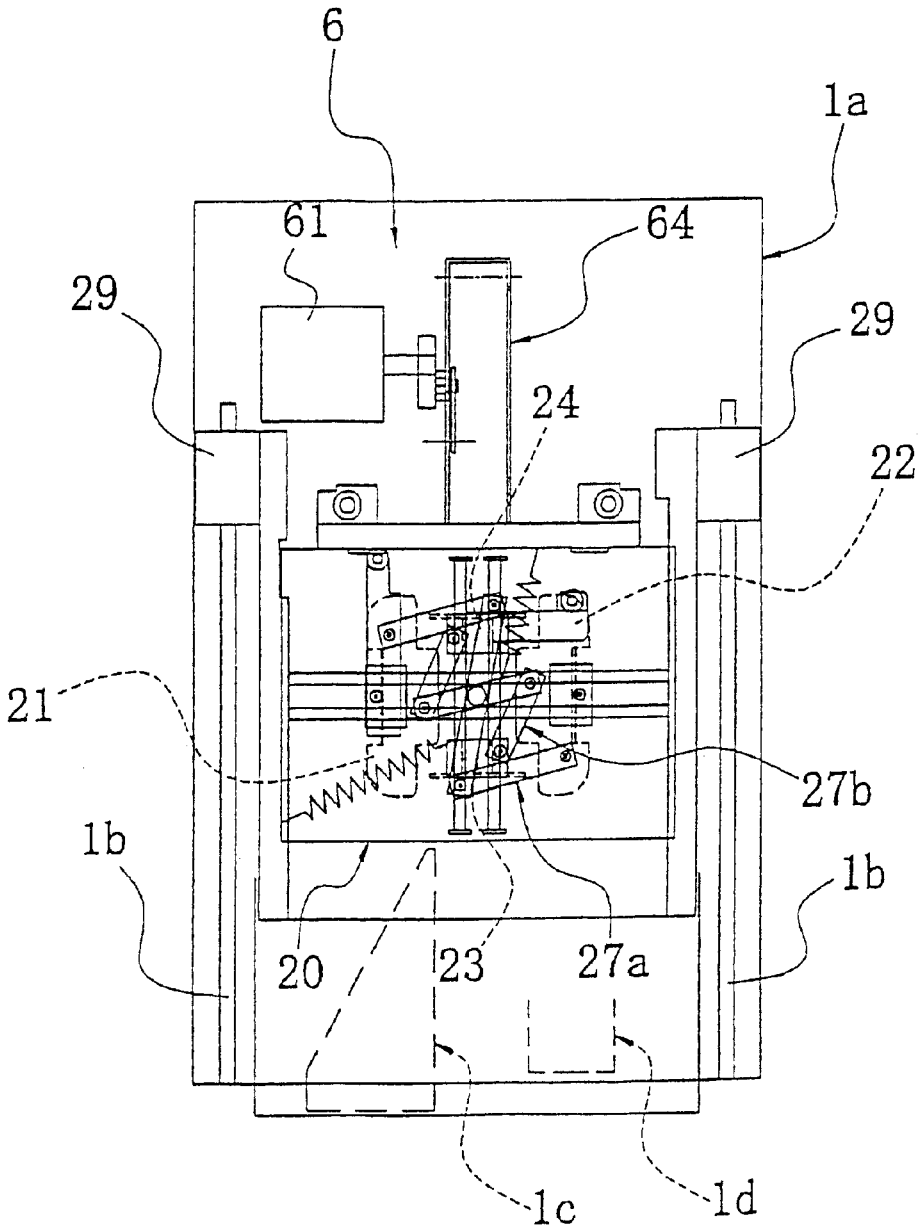
FIG. 18 is a plan view showing the arrangement of the members of the link mechanism and others of the tray carrying and holding mechanism in the pushed-in state.

The casing 20 carries various members, and can move longitudinally (forward and backward) together with the longitudinally movable guide members 29*a* carrying the casing 20. Also, the casing 20 is guided by the vertically movable guide members 29*b* along vertical guide rails 69, and can be vertically moved by the lift mechanism 6. A fixed support plate 20*a* for carrying the tray T is fixed to the casing 20. The fixed support plate 20*a* is provided with recesses for avoiding interference with moving members, i.e., first to fourth tray holding members 21–24, as shown in FIG. 16.

The first and second tray holding members 21 and 22 center the tray T in the lateral direction (i.e., performs the lateral positioning), and prevents the positional deviation of the tray T in the lateral direction by laterally holding the opposite sides of the tray T. The first and second tray holding members 21 and 22 are provided at their upper portions with contact portions 21*a* and 22*a* for lateral contact with the opposite side surfaces of the tray T, respectively. The contact portions 21*a* and 22*a* are provided at their lower surfaces with tray lower surface support plates 21*b* and 22*b* extending inward, respectively. The tray lower surface support plates 21*b* and 22*b* can be located between the tray T and the fixed support plate 20*a* when the tray carrying and holding mechanism 2 moves horizontally to the position under the roller 3 (see FIG. 12).

The third and fourth holding members 23 and 24 center the tray T in the longitudinal direction (i.e., performs the longitudinal positioning), and hold the longitudinally opposite sides of the tray T for preventing positional deviation in the longitudinal direction. The third and fourth tray holding members 23 and 24 are provided at their upper portions with contact portions 23*a* and 24*a* to be in longitudinal contact with the opposite side surfaces of the tray T.

The first and second tray holding members 21 and 22 are supported by the link mechanism 27*a* for performing laterally and longitudinally symmetrical movements with respect to a central axis 27*c*, and the third and fourth tray holding members 23 and 24 are supported by the link mechanism 27*b* for performing laterally and longitudinally symmetrical movements with respect to the central axis 27*c*. The first and second tray holding members 21 and 22 are carried by the casing 20 via the lateral guide shafts 25. The third and fourth tray holding members 23 and 24 are carried by the casing 20 via the longitudinal guide shafts 26. The opposite ends of each of the lateral and longitudinal guide shafts 25 and 26 are fixed to the casing 20.

Figure 19:
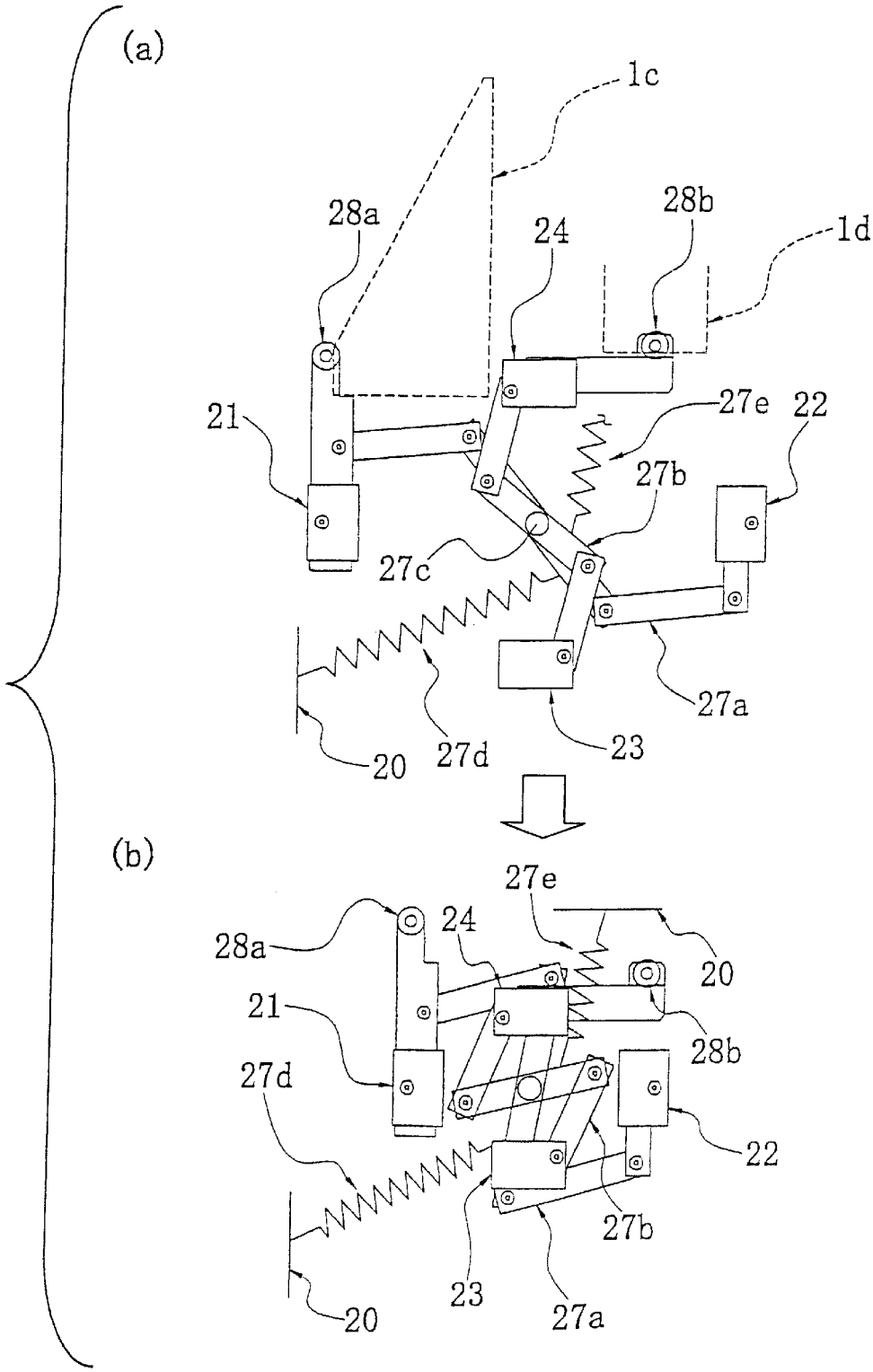
FIG. 19 is a plan view showing, on an enlarged scale, the arrangement of the members of the link mechanism and others of the tray carrying and holding mechanism in the pushed-in and pulled-out states.

The link mechanism 27*a* is configured to be symmetrical with respect to the central axis 27*c*, and has opposite ends coupled via axes to the lower portions of the first and second tray holding members 21 and 22, respectively. The link mechanism 27*a* is biased by the coil spring 27*d* to move its opposite ends inward, as shown in FIG. 19.

The link mechanism 27*b* is configured to be symmetrical with respect to the central axis 27*c*, and has the opposite ends coupled via axes to the lower portions of the third and fourth tray holding members 23 and 24, respectively. The link mechanism 27*b* is biased by the coil spring 27*e* to move its opposite ends inward, as shown in FIG. 19.

The central axis 27*c* is arranged to be located on the center of the tray T when the lift mechanism 6 lifts the tray carrying and holding mechanism 2. More specifically, the central axis 27*c* is arranged on a straight line extending between the two pivot axes 81*a* and 81*b* in a plan view. Although this embodiment employs the coil springs 27*d* and 27*e*, the biasing means may be formed of an electric motor, a pneumatic cylinder, a hydraulic cylinder, or the like.

The first roller 28*a* is restricted by a first roller guide member 1*c* integral with the frame 1*a*, and is rotatably carried by an end of a member, which extends from the lower portion of the first tray holding member 21 toward the longitudinally inner position.

The second roller 28*b* is restricted by a second roller guide member 1*d* integral with the frame 1*a*, and is rotatably carried by an end of a member, which extends rightward from the lower portion of the fourth tray holding member 24.

The vertically movable guide member 29*b* is fixed to the casing 20, and is vertically movably engaged with the vertical guide rail 69.

[Operation of the Tray Carrying And Holding Mechanism]

Description will now be given on the operation of the tray carrying and holding mechanism 2.

The pulled-out state of the tray carrying and holding mechanism 2 is shown in FIGS. 12*a*, 12*b*, 14, 16(*a*), 17, and 19(*a*). The pushed-in state, where the tray carrying and holding mechanism 2 is horizontally moved to the position under the roller 3, is shown in FIGS. 13*a*, 13*b*, 15, 16(*b*), 18, and 19(*b*).

In the pulled-out state, the tray T is laid on the fixed support plate 20*a* in the upper portion of the casing 20, and the tray carrying and holding mechanism 2 is pushed to a position under the roller 3. Thereby, the tray carrying and holding mechanism 2 laid on the longitudinally movable guide member 29*a* moves horizontally to the pushed-in position. The longitudinally movable guide member 29*a* is longitudinally movably engaged with a pair of the horizontal guide rails 1*b*, which are integral with the frame 1*a*.

As the tray carrying and holding mechanism 2 is pushed in, the first roller 28*a* restricted by the first roller guide member 1*c* gradually moves rightward along the inclined surface of the first roller guide member 1*c*. When the first roller 28*a* is disengaged from the first roller guide member 1*c*, the first roller guide member 1*c* no longer restricts the first roller 28*a* Thereby, the first and second tray holding members 21 and 22 biased by the coil spring 27*d* move inward, as shown in FIGS. 16(*b*) and 19(*b*). In this operation, the first and second tray holding members 21 and 22 move horizontally along the lateral guide shafts 25. The contact portions 21*a* and 22*a* of the first and second tray holding members 21 and 22 come into contact with the side surfaces of the tray T, and hold laterally opposite sides of the tray T so that the first and second tray holding members 21 and 22 stop their inward motion.

When the tray carrying and holding mechanism 2 is pushed in to a certain extent, the second roller 28*b*, which has been restricted by the second roller guide member 1*d*, is disengaged therefrom, and is no longer restricted by the second roller guide member 1*d*. Thereby, the third and fourth tray holding members 23 and 24 biased by the coil spring 27*e* move inward, as shown in FIGS. 16(*b*) and 19(*b*). In this operation, the third and fourth tray holding members 23 and 24 move horizontally along the longitudinal guide shafts 26. The contact portions 23*a* and 24*a* of the third and fourth tray holding members 23 and 24 come into contact with the side surfaces of the tray T, and hold the longitudinally opposite sides of the tray T so that the third and fourth tray holding members 23 and 24 stop their motion.

When the tray carrying and holding mechanism 2 is pushed to the position under the roller 3 in the above manner, the first to fourth tray holding members 21–24 move toward the central axis 27*c* for centering the tray T, and the contact portions 21*a*–24*a* hold the four side surfaces of the tray T, respectively (see FIGS. 13(*b*) and 16(*b*)).

The tray carrying and holding mechanism 2 holding the tray T is vertically lifted by the lift mechanism 6 along the vertical guide rail 69.

[Feature of the Wrapping Device of the Embodiment]

(1)

According to the first aspect of the present invention, since the stretch mechanism 9 is employed, the wrinkles on the stretch film Fm covering the opening o of the tray T can be stretched to improve the appearance in the wrapped state.

In the wrapping device 1, the stretch mechanism 9 operates only for the restricted period, i.e., only during a series of operations for welding the stretch film Fm to the tray T. Thus, the stretch mechanism 9 does not operate during transportation of the stretch film Fm by the film transporting mechanism 5. Therefore, even if the stretch film Fm is thin and does not have sufficient rigidity, disadvantages such as meandering do not occur during transportation.

(2)

In the wrapping device 1, the stretch film Fm is stretched before the lift mechanism 6 pushes the tray T against the stretch film Fm (see FIG. 10(*b*)). Therefore, when the stretch film Fm is pushed against the tray T, no wrinkle is present on the stretch film Fm, and the stretch film Fm having no wrinkle covers the opening o of the tray T.

(3)

The wrapping device 1 is controlled such that the lift mechanism 6 pushes the tray T against the stretch film Fm, and thereafter the tension of the stretch film Fm is reduced (see FIG. 11(*d*)). Therefore, a situation does not occur such that the stretch film Fm is excessively stretched due to the lifting of the tray T by the lift mechanism 6 after the stretch film Fm is pushed against the tray T. Thereby, it is possible to prevent disadvantages such as occurrence of pin holes, breakage of the film, and insufficient welding, which may be caused by excessive stretching of the stretch film Fm. Owing to the above control, even a tray of a low strength can be sealingly wrapped while suppressing deformation.

(4)

In the wrapping device 1, the tension is kept in the portion of the stretch film Fm outside the welded portion when welding the stretch film Fm to the tray T (see FIGS. 11(*d*) and (*e*)). Therefore, the stretch film Fm can be easily cut off by melting the portion of the stretch film Fm outside the portion welded to the tray T.

(5)

In the wrapping device 1, the rollers 3 weld the stretch film Fm to the tray T, and thereafter the stretch film Fm is stretched again. Therefore, a disadvantage can be suppressed in which a remaining portion of the stretch film F, which was partially cut out, clings to the tray T and/or the tray carrying and holding mechanism 2. Even when the thermal cutting is incomplete, the stretch film Fm can be completely cut off by stretching it.

(6)

In the prior art, the stretch film is transported while pinching the opposite sides by belts or the like, or holding the film with clamps attached to chains or the like moving in the transporting direction. However, these transporting structures require large and expensive devices.

In view of the above, the wrapping device 1 of this embodiment is configured to wind the stretch film Fm, which is payed out from the film roll R, around the winding shaft 53*a* of the film winding portion 53, and the film transportation is performed without a holding operation. Thus, the film transporting mechanism 5 is completely independent of the holding mechanism (film holding portions 91*a* and 91*b* of the stretch mechanism 9). Thereby, the device 1 can be compact, and occupies only a small space.

(7)

In a stretch wrapping device of the over-wrapping type in the prior art, the stretch film is bent to cover the bottom of the tray. Therefore, the required positioning accuracy can be relatively low. In the wrapping device of the top-seal type of this embodiment, the tray T must be positioned with high accuracy with respect to the rollers 3.

In the wrapping device 1 of the embodiment, the first and fourth tray holding members 21–24 hold the side surfaces of the tray T to prevent positional deviation of the tray T, which may be caused by the contact with the roller 3 during welding of the stretch film Fm to the tray T, as well as the positional deviation, which may be caused due to pushing the stretch film Fm by the lifted tray T. Therefore, the tray T can be located at the optimum position in the pivoting range of the rollers 3, and the rollers 3 can come into contact with the flange f in the designed manner. Thereby, it is possible to suppress the sealing failures due to positional deviation of the tray T.

(8)

In the wrapping device 1, the first to fourth holding members 21–24 hold the tray T while positioning or centering the tray T by these holding members 21–24. For this centering, the tray carrying and holding mechanism 2 employs the link mechanisms 27*a* and 27*b* as well as coil springs 27*d* and 27*e*. Therefore, the tray T centered with respect to the central axis 27*c* is held and pushed against the stretch film Fm, and the rollers 3 weld the stretch film Fm to the tray T.

(9)

In the wrapping device 1, the tray holding members 21–24 hold and center the tray T, which is laid on the tray carrying and holding mechanism 2, and the tray carrying and holding mechanism 2 is lifted together with the tray T by the lift mechanism 6. Therefore, the positional deviation of the tray T is suppressed during either of the transportation to the lift mechanism 6 (in the pushed-in state of the tray carrying and holding mechanism 2) and the lifting by the lift mechanism 6.

(10)

In the wrapping device 1 of this embodiment, since the rollers 3 pivot during the heat-seal operation, a force acting to move the tray T (i.e., a force containing a horizontal component) is applied to the tray T. Therefore, the tray holding members 21–24, which hold the tray T during the heat-sealing, can achieve a particularly large effect.

(11)

In the wrapping device 1 of this embodiment, the tray lower surface supporting plates 21*b* and 22*b*, which support the laterally opposite end portions of the lower surface of the tray T, move together with the contact portions 21*a* and 22*a* in accordance with the lateral width of the tray T (see FIG. 16). Thus, the sizes of the portions supporting the lower surface of the tray T change in accordance with the size of the tray T. Thereby, it is possible to avoid the interference between the rollers 3 with the members supporting the lower surface of the tray T during the heat-seal operation. Also, it is possible to avoid the interference between the stretch film Fm and the members supporting the lower surface to the tray.

[Specific Structures of the Winding Shaft]

Since the stretch film Fm has high elasticity and self-adhesion, it is difficult to pull out the wound stretch film Fm from the winding shaft if the winding shaft is merely made of a cylindrical member.

Therefore, the winding shaft may be formed of a paper tube or the like. However, it is desired to collect only the wound stretch film Fm for disposal or recycling.

Figure 20:
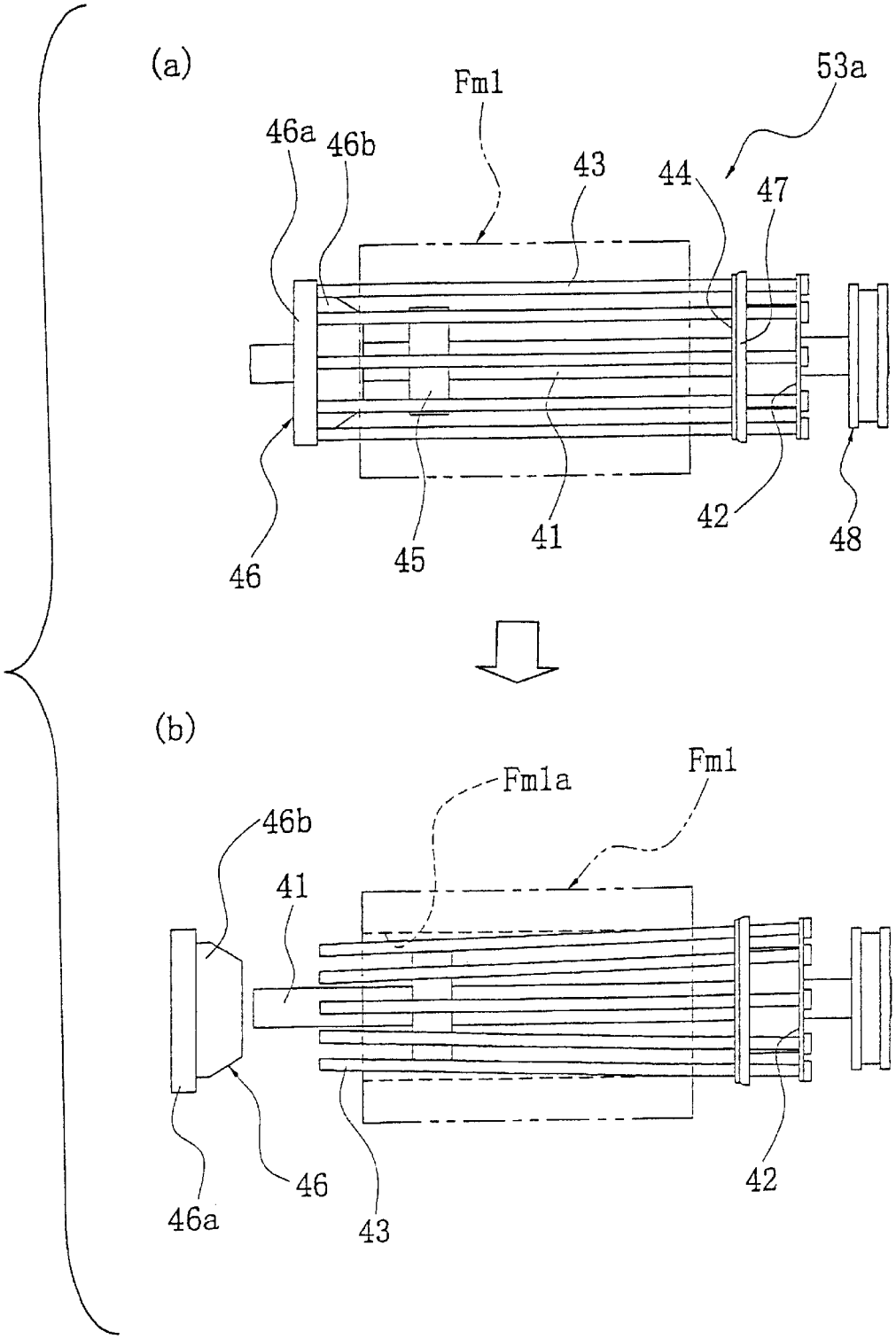
FIG. 20 is a view showing a structure of a winding shaft and its operating manner.

In view of the above, the wrapping device 1 of this embodiment employs the winding shaft 53*a* shown in FIG. 20(*a*). The winding shaft 53*a* is formed of a support shaft 41, a fixed plate 42, winding guides 43, a guide plate 44, a guide pulley 45, a removable guide 46, a rubber belt 47, and a torque pulley 48.

The plurality of winding guides 43 are swingably supported by the fixed plate 42. The guide plate 44 is provided with radially long apertures, through which the winding guides 43 extend, respectively. Therefore, the guide plate 44 allows swinging of the winding guides 43. The rubber belt 47 is arranged near the guide plate 44 for inwardly biasing the winding guides 43. The guide pulley 45 serves to adjust radial positions of the ends (left ends in FIG. 20) of the winding guides 43 with respect to the shaft 41 (see FIG. 20(*b*)).

The removable guide 46 is formed of a circular plate portion 46*a*, which is in contact with the ends of the winding guides 43, and a guide portion 46*b* protruding from one end surface of the circular plate portion 46*a* into the winding guides 43. Except for a portion (left portion in FIG. 20) near the circular plate portion 46*a*, the guide portion 46*b* is tapered to converge toward the fixed plate 42. When assembled as shown in FIG. 20(*a*), the removable guide 46 supports the inner sides of the ends of the winding guides 43, and holds the respective winding guides 43 in the parallel position. The belt 53*b* is retained around the torque pulley 48.

When waste film Fm1 is wound around the winding shaft 53*a* having the above structure, and is to be removed or pulled out, the removable guide 46 is removed, as shown in FIG. 20(*b*). Thereby, the ends of the winding guides 43 move radially inward to form a space with respect to an inner peripheral surface Fm1*a* of the waste film Fm1, which was in intimate contact with the winding guides 43. Thereby, the waste film Fm1 can be easily pulled out.

[Determination of the Prestretch Amount And Others]

Before pushing up the tray T against the stretch film Fm, the stretch film Fm is stretched by an amount (i.e., prestretch amount), which is determined based on the following parameters. These parameters can de determined by calling out the tray size, tray material and others, which are stored in the tray master file 14*a*, based on the entered tray number or the like.

(a) size of tray T (b) width of film roll R (c) material of stretch film Fm (d) material of tray T (e) form of tray T (f) peripheral temperature Using the parameters (a) and (b) described above, the optimum prestretch amount can be determined based on the relative relationship between the width of the stretch film Fm and the width of the tray T.

Using the parameter (c), the prestretch amount can be determined in view of the characteristics such as resistance to ripping based on the material.

Using the parameter (d), it is possible to suppress crush of the tray T due to insufficient strength of the tray T.

Using the parameter (e), it is possible to suppress breakage of the film due to the form of the edge of the tray T.

Using the parameter (f), the prestretch amount can be determined in view of a variation of the hardness of the tray T depending on the temperature.

Further, the film holding portions 91*a* and 91*b* return to the inner positions when the film is pushed up by the tray T, and the timing and amount of this return are determined based on the above parameters.

[Determination of the Film Transporting Amount]

When a wrapping start signal is input, the size of the tray T to be wrapped is determined. Thereafter, the film transporting operation is performed. The amount of film transported in this operation may be determined in the following manners (M1) and (M2).

(M1)

The amount of the film, which was transported after completion of the last wrapping (and is equal to the amount required for the wrapped tray), is compared with the transportation amount of the film required for the current tray, and the amount for complementing the shortage is transported.

(M2)

The amount of the film, which is transported (wound) after completion of the last wrapping, is restricted to the allowed minimum value, and the amount complementing the shortage is transported before the current wrapping of the tray.

According to the method (M1), a shortage does not occur, and the film transportation is not performed if the tray requires transportation of an amount that is equal to or smaller than that in the last operation. Only when the required amount of the transported film is larger than that in the last operation is the amount of the film corresponding to the shortage transported. Thus, the wrapping can be performed without transporting film if the tray size is equal to or smaller than that of the last tray. However, an excessive amount of film is transported if the new tray requires transportation of a smaller amount of film. Therefore, a large amount of film is wasted if the amount of transported film is frequently changed for flexible production (i.e., production of small batches of a variety of products).

In contrast to the above, the above manner (M2) can prevent waste of film.

From the above consideration, the wrapping device 1 of the embodiment employs the manner (M2).

In either of the manners (M1) and (M2), the film transportation after the last wrapping is performed in parallel with other operations such as discharging of the wrapped tray. Therefore, these manners (M1) and (M2) cause no difference in wrapping performance.

[Film Changing]

When the stretch film Fm is completely payed out from the film roll R, the film changing is performed in the following manner.

Figure 21:
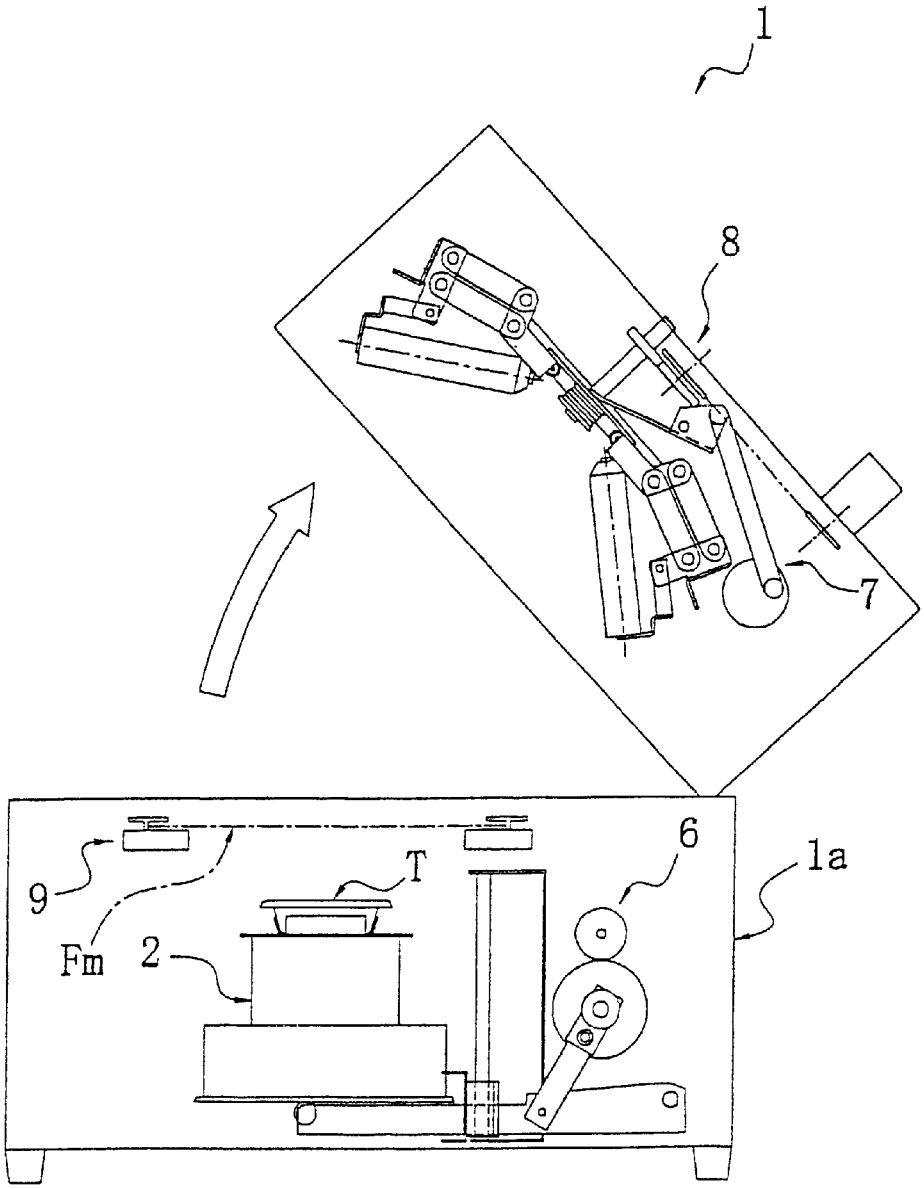
FIG. 21 is a view showing an open state of the seal unit.

First, as shown in FIG. 21, the seal unit formed of the roller elevating mechanism 7, roller pivoting mechanism 8, the rollers 3, and others is opened.

Then, the stretch film Fm extending from the film roll R to the winding shaft 53*a* is cut at some midpoint, and the film roll R is removed. If the waste film Fm1 wound around the winding shaft 53*a* is large in volume, the removable guide 46 is removed as already described, and the waste film Fm1 is removed (see FIG. 20).

Then, the new film roll R is attached, and the stretch film Fm is extended via the payoff roller 52*a* and the film support roller 52*d*, and is wound around the winding shaft 53*a*.

Then, the seal unit is closed, and the stretch film Fm is fed by performing an idle operation two or three times. Thereby, the film changing operation is completed.

[Other Embodiments]

(A)

The embodiment already described employs a structure in which the transporting mechanism and the holding mechanism are completely independent of each other, for achieving the compact structure of the device 1 instead of employing the conventional transporting structure, in which the transportation is performed while holding the stretch film, e.g., by clamps.

However, the invention can be applied to the device employing the transporting structure for transporting the stretch film while holding it, as is done in the prior art. In this case, however, the following control is required because the transportation must be performed for winding up the stretch film Fm, which was partially cut out for the wrapping.

The stretch film Fm extending from the film roll R to the position above the tray carrying and holding mechanism 2 is not cut out, and therefore can be transported while applying a tension to the stretch film Fm by holding it. In the transportation path for the partially cut-out stretch film Fm (i.e., the path extending from the position above the tray carrying and holding mechanism to the film winding portion 53) applying tension to the stretch film Fm is strictly inhibited. If the stretch film Fm having a partially cut-out portion is transported under tension, meandering, entangling around transporting members, tearing off, and/or the like are liable to occur. At least in the transportation path of the film, which is partially cut out, control must be performed to prevent application of tension to the stretch film Fm.

More specifically, control may be performed such that tension is not applied to the stretch film Fm at least in the transportation path of the stretch film Fm from the position above the tray T (above the tray carrying and holding mechanism 2) to the film winding portion 53.

Also, detecting means for detecting an open portion in the stretch film Fm, which is formed by thermally cutting out the film, is employed. The control may be performed such that tension is not applied at least to the portion of the stretch film Fm including the open portion detected by the detecting means and located near the opening.

According to this control, tension is not applied to the stretch film Fm having a portion that is thermally and partially cut out. Therefore, disadvantages such as meandering and entangling can be prevented even if the strength and rigidity of the stretch film Fm are further reduced due to the partial cut-out.

(B)

In the above embodiment, the film holding portions 91*a* and 91*b* on the left and right in FIG. 2 are selectively turned on/off by the solenoids 92*a* and 92*b*, respectively. Thus, each of the film holding portions 91*a* and 91*b* can be controlled to select only the two states, i.e., the holding state for holding the stretch film Fm between all the pads p1–p8 and the lower member 94, and the releasing state for releasing the film.

However, a structure may be employed such that the holding state and the releasing state can be selected in each of various positions on the transportation path of the stretch film Fm in accordance with the form of the tray. This structure allows control for achieving more stable wrapping.

Therefore, the wrapping device 1 of the foregoing embodiment may be improved as follows, if allowed in view of the cost.

In this improved structure, a solenoid is prepared for each of the pads p1–p8, and control portion 10 is configured to control the sixteen solenoids. Thereby, the stretch film Fm can be selectively held and stretched in accordance with the form and size of the tray. Each solenoid may be controlled to be turned on/off in accordance with the foregoing parameters (a)-(f), whereby the wrapping can be performed more appropriately.

Each of the pads p1–p8 may be movable on a plane, or may be arranged in the position corresponding to the form of the tray, which is frequently used. This allows for a more stable wrapping operation. For example, each of the pads p1 and p8 at the front and rear ends in the film transporting direction may be disposed in position that are shifted inward.

Figure 24:
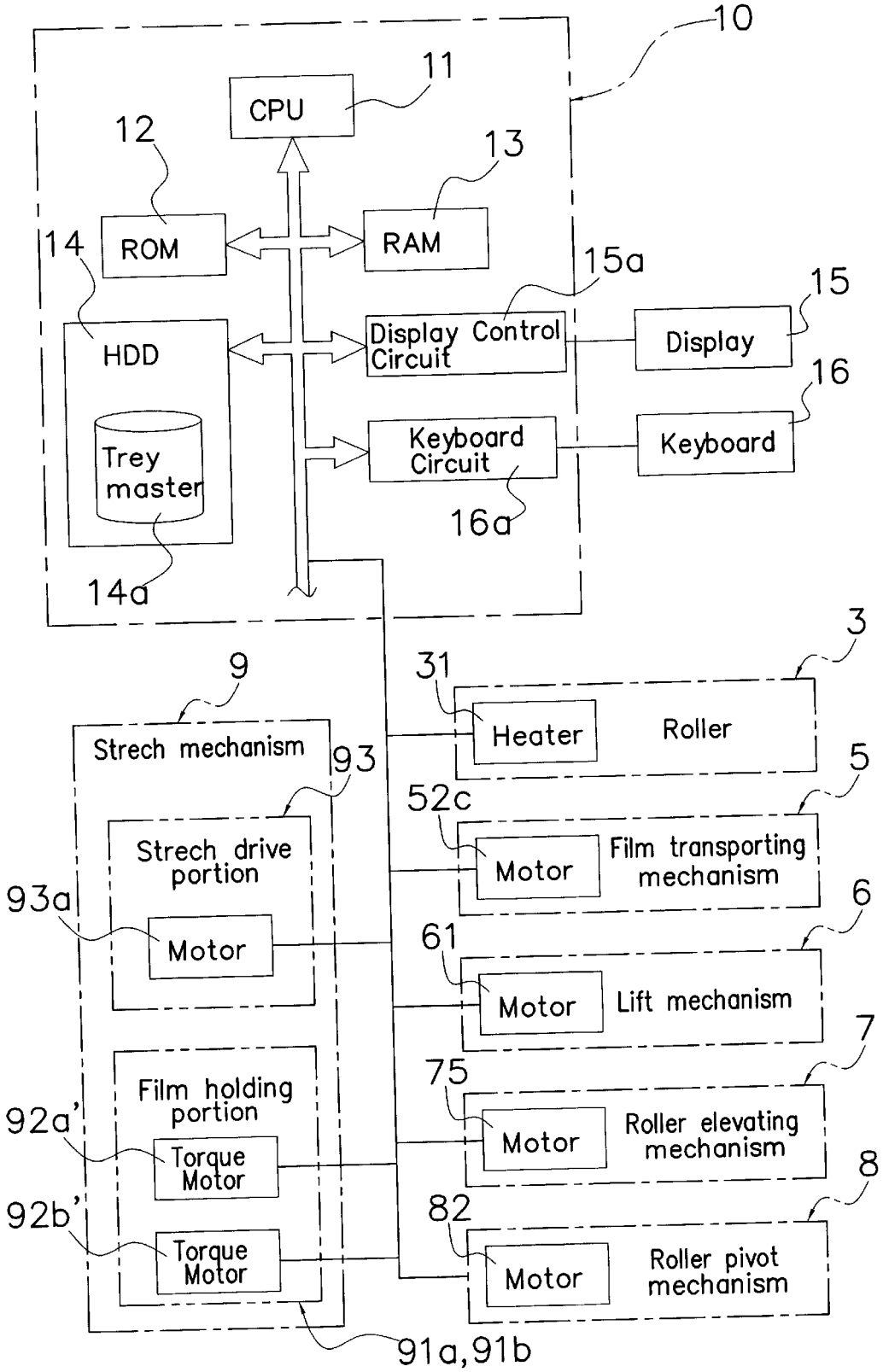
FIG. 24 is a view of a block diagram showing control of the wrapping device having torque motors in accordance with an alternative embodiment.

Further, the solenoid may be replaced with a torque motors 92*a*′ and 92*b*′ for holding the stretch film Fm by each of the pads p1–p8 with an adjustable holding force as shown in FIG. 24. This allows more fine wrapping control.

(C)

In the foregoing embodiment, tension is applied to the stretch film Fm by the stretch mechanism 6, which stretches the stretch film Fm in the direction (lateral direction in FIG. 2) perpendicular to the transporting direction of the stretch film Fm. Instead of, or in addition to this, the wrapping device 1 may be improved to allow stretching of the stretch film Fm in the transporting direction of the stretch film Fm. For example, such a modification may be employed that the film winding portion 53 moves through a predetermined range in the transporting direction of the stretch film Fm, whereby the tension of the stretch film Fm in the substantially transporting direction can be controlled more finely.

(D)

In the embodiment already described, the prestretch amount is determined by retrieving the tray size, tray material, or the like, which are stored in the tray master file 14*a*, in accordance with a tray number or the like entered via the keyboard 16. Alternatively, image capturing means such as a CCD camera may be used to capture an image of the tray T, and the tray form may be determined by processing the captured image. Based on the tray form thus determined, the respective data in the tray master file 14*a* may be retrieved. Also, a sensor may be used to scan the tray T widthwise to measure the tray width, and the longitudinal size of the tray T may be measured by the sensor when bringing in the tray T. Based on these sizes, the respective data in the tray master file 14*a* may be retrieved.

In this case, the tray size detecting means such as a CCD camera or a sensor may be arranged in an upper right or left position with respect to the tray carrying and holding mechanism 2 in the pulled-out position indicated by alternate long and two short dashes line in FIG. 2.

(E)

In the above embodiment, the drive motor 52*c* operates to rotate the payoff roller 52*a* and the winding shaft 53*a*. The structure may be improved to rotate the film support roller 52*d* by the drive motor 52*c*, whereby it can be expected that the stretch film Fm is transported more stably.

(F)

In the embodiment shown in FIG. 2 and others, the stretch film Fm, which is not yet stretched is wider than the tray T. However, the stretch film Fm, which is not yet stretched, may be narrower than the tray T. Even in this case, the stretch film Fm can be stretched to have a width larger than that of the tray T, whereby the stretch film Fm can be continuous even after the welding to the tray T, and therefore can be transported to the film winding portion 53 without any difficulty.

In view of resource savings, the stretch film Fm (film roll R) having a small width of an intended value can be used, and the control may be performed such that the prestretch amount is small for a small tray T, and the prestretch amount is large for a large tray T. This can achieve such a secondary effect that only one kind of stretch film Fm having a small width can be used for the trays of various widths.

(G)

When the rollers 3 pivot in the above embodiment, the rollers 3 are kept in contact with the tray T with the stretch film Fm therebetween so that the rollers 3 may scan the whole flange f. However, the invention can also be applied to the wrapping device employing a manner such that the tray T is pushed and brought into contact with the lower side of an elastic heat-generating sheet of a domed form.

Laser beams may be applied to the flange f of the tray T, and may be moved along the flange f for welding and thermally cutting the film in a non-contact manner.

(H)

In the above embodiment, the tray T is centered in the stage of horizontally pushing the tray carrying and holding mechanism 2 to the position under the rollers 3. However, the centering in this stage is not essential. The tray T can be positioned (centered) in any stage before the tray T comes into contact with the stretch film Fm during lifting of the tray T.

(I)

The following structures may be employed in addition to the structure of the above embodiment. The contact portions 21*a*–24*a* of the tray holding members 21–24 may be provided at its contact surfaces, which can be in contact with the tray T, with pressure sensors or proximity switches, which can detect the contact between the tray holding members 21–24 and the tray T, so that the contact of the tray holding members 21–24 with the side surfaces of the tray T may be detected. When the tray T is not sufficiently held, the above structure allows detection of such an error, and can stop the wrapping process.

The tray master file 14*a* may store the intended or predetermined transportation amounts of the tray holding members 21–24 for each kind of tray so that the tray holding members 21–24 may be moved in accordance with the transportation amounts thus stored.

(J)

In the above embodiment, the tray holding members 21–24 hold the side surfaces of the tray T primarily for preventing positional deviation on a plane. In addition to this, a member(s) for restricting the positional deviation of the tray T in the vertical direction may be employed. This structure can suppress the positional deviation of the tray T due to floating of the tray T in the tray lifting operation.

More specifically, the structure may be provided with a member for absorbing the lower surface of the tray T or engaging with the flange f of the tray T from the upper side. However, if the member pushing the flange f from the upper side is employed, this member must retreat during the heat-seal operation so that a mechanism for this retreating is also required.

(K)

In the above embodiment, the tray carrying and holding mechanism 2 has both a centering function and a tray holding function. However, a tray support table and tray holding members may be arranged in the lift mechanism 6, and the centering function may be provided in a transporting path extending to the lift mechanism 6.

Figure 22:
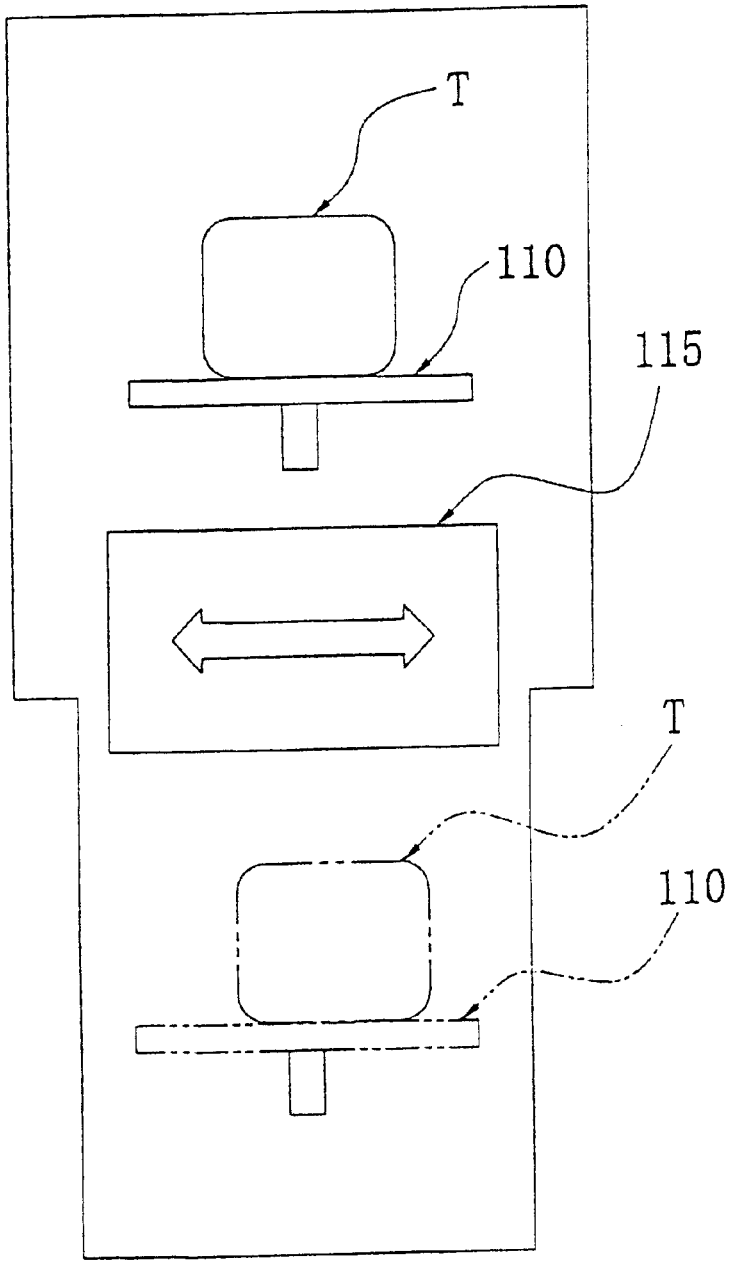
FIG. 22 is a view showing an arrangement of a belt conveyor in a transporting path according to an alternate embodiment of the present invention.

For example, as shown in FIG. 22, a pushing amount of a pusher 110 may be controlled for longitudinally centering the tray T, and a belt conveyor 115, which can move laterally, may be arranged at some midpoint on the transportation path for laterally centering the tray T. In this structure, a CCD camera or a plurality of sensors is used to determined the lateral and longitudinal sizes of the tray T. The pusher 110 and the belt conveyor 115 are controlled based on the sizes thus determined. More specifically, a plurality of sensors of a reflection type or the like may be disposed in the lateral direction of the tray T. A sensor for monitoring in the direction perpendicular to the transporting direction (longitudinal direction) of the tray T may be disposed.

Figure 23A:
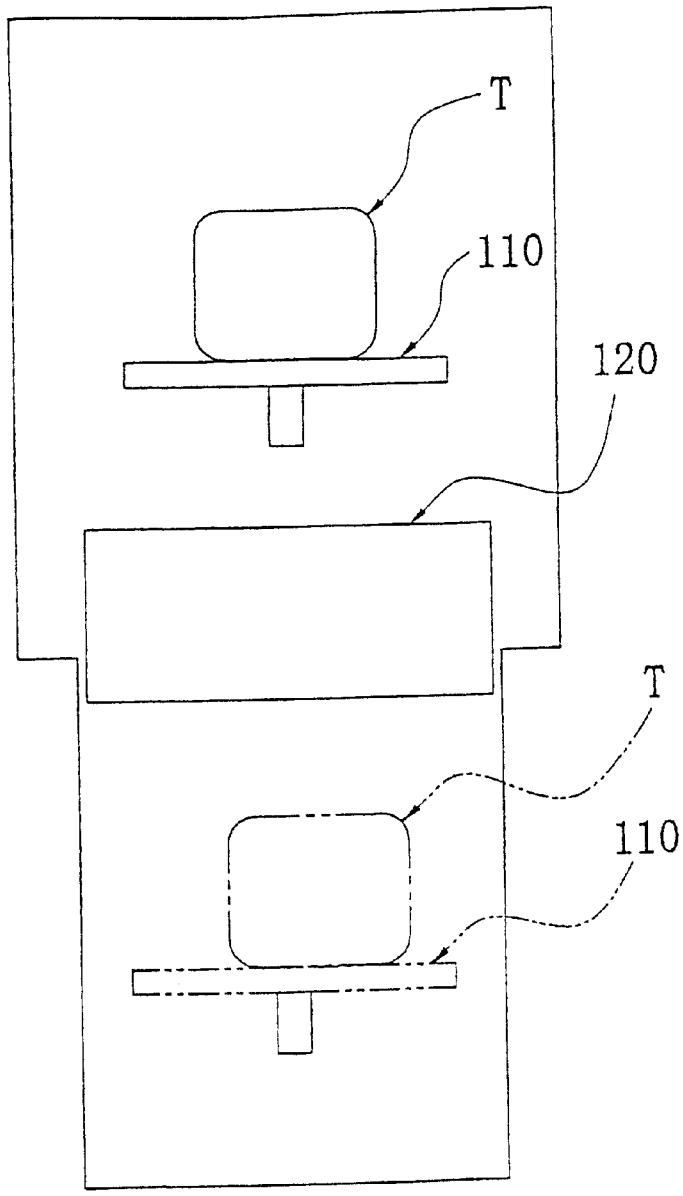
FIG. 23 is a view showing a structure of a guide drive mechanism in the transporting path of the embodiment shown in FIG. 22.
Figure 23B:
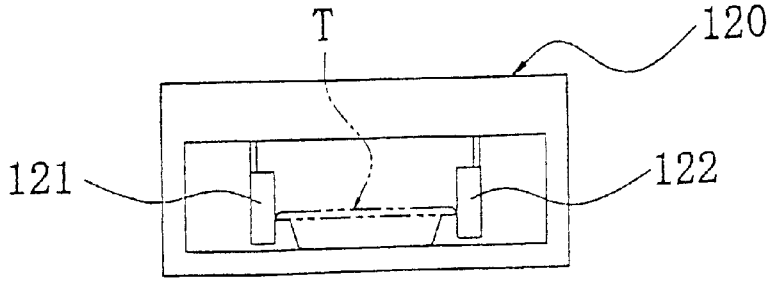

As shown in FIGS. 23*a* and 23*b*, the longitudinal centering may be performed by controlling the pushing amount of the pusher 110. The lateral centering may be performed by a guide drive mechanism 120 arranged at some midpoint on the transportation path. The guide drive mechanism 120 has transportation guides 121 and 122, which can come into contact with the outer sides of the laterally opposite ends of the tray T for laterally positioning the tray T. Motion of these transportation guides 121 and 122 is controlled to center laterally the tray T based on the width of the tray T obtained from the result of processing images captured by the CCD camera or the result of detection by the sensors.

(L)

In the above embodiments, the tray holding members 21–24 hold the side surfaces of the tray T for primarily preventing the positional deviation of the tray T on a plane. Instead of or in addition to this, the bottom of the tray T may be absorbed for holding it. More specifically, the central portion of the fixed support plate 20*a* of the tray carrying and holding mechanism 2 may be provided with an aperture, which is connected to a suction device via a piping.

(M)

In the above embodiment, the coil springs 27*d* and 27*e* are employed as means for inwardly biasing the tray holding members 21–24 holding the tray T. These may be replaced with a torque motor or the like for allowing adjustment of the biasing force.

If the coil springs 27*d* and 27*e* are replaced with the biasing means such as a torque motor or a pneumatic cylinder, which can adjust the biasing force, the control portion 10 can change the holding force for holding the tray T in accordance with the parameters such as a hardness and a material of the tray T. For example, a control may be performed to reduce the biasing force (holding force) for the soft tray T, and to increase the biasing force (holding force) for the hard tray T. Thereby, the positional deviation of the tray T can be reliably prevented, and at the same time, a sealing failure due to deformation of the tray T can be suppressed. Further, the biasing force of the biasing means, and thus the tray holding force can be adjusted also depending on the characteristics of the stretch film Fm such as thickness and material.

Further, means (biasing force detecting means) such as pressure sensors for confirming the holding force may be arranged on the contact portions 21*a*–24*a* of the tray holding members 21–24. Thereby, it is possible to verify the biasing force applied by the biasing means such as a pneumatic cylinder. The control portion 10 may be configured to control the biasing force of the biasing means based on the detection result from the biasing force detecting means. Thereby, disadvantages such as sealing failure due to deformation of the tray T can be prevented.

(N)

The wrapping device 1 of the above embodiment does not have a measuring function. However, the device may be configured to measure a total weight of the tray T and the contents when the tray T is laid on the tray carrying and holding mechanism 2 in the pulled-out position, and then perform a series of wrapping processing.

In this case, for shifting to the wrapping processing, the control portion 10 must receive a wrapping start request, size information (tray size and total height) of the wrapping target a material of the stretch film, and a material of the tray. Among them, the wrapping start request can be supplied to the control portion 10 in the following manners.

(a) A weighing instrument is arranged in the tray carrying and holding mechanism 2 so that the weight of the tray T is measured, and the wrapping operation starts in accordance with the weight stabilization signal.

(b) A sensor, a proximity switch, or the like detects the tray T laid on the tray carrying and holding mechanism 2, and starts the wrapping operation in accordance with a detection signal produced thereby.

(c) A CCD camera or the like recognizes the tray T laid on the tray carrying and holding mechanism 2, and starts the wrapping operation in accordance with the recognition completion signal. When the recognition is completed, the tray size is written into the data region within the RAM 13 of the control portion 10.

(d) An operator starts the wrapping operation, e.g., by pushing a wrapping start button.

In the above manners (a) and (b), wrapping condition values such as a tray size are entered, e.g., by calling out the tray master file 14*a*, which has been set in the control portion 10. Thereby, the device can start the wrapping of the tray T corresponding to the wrapping start signal supplied thereto.

In the manner of (c), the tray master file 14*a* matching with the t recognized tray size is retrieved from the file already stored, and thereby the wrapping conditions can be set.

In the manner (d), the operation for retrieving the tray master file 14*a* is independently requiring, similarly to the manners (a) and (b).

In the manner (c), the wrapping can start in response to only the operation of placing the tray T on the tray carrying and holding mechanism 2. In the manners (a) and (b), the wrapping can start in response to the operations of calling out the tray master file 14*a* and placing the tray T. In the manner (d), the wrapping can start in response to the operations of calling out the tray master file 14*a*, placing the tray T and inputting the wrapping start signal.

The above manners (a)-(d) can be selected in view of the productivity, cost and others.

(Industrial Applicability)

According to the invention, since the stretch film is wound after the thermal cutting, the thin stretch film having substantially no rigidity can be sent by the transporting mechanism in a compact structure. Since the stretch mechanism is employed for stretching the stretch film at least before welding the stretch film to the tray, wrinkles are, therefore, removed from the stretch film covering the opening of the tray, resulting in a good appearance in the wrapped state.

What is claimed is:

1. A top-seal wrapping device arranged to cover a top opening of a tray containing a wrapping target with a stretch film, and to weld the stretch film to a peripheral portion of the tray around the opening while thermally cutting the stretch film, comprising:

a stretch mechanism arranged to stretch the stretch film;

welding means for welding the stretch film to the peripheral portion of the tray;

control means operatively coupled to said stretch mechanism for controlling the stretching of the stretch film by operating said stretch mechanism at least before said welding means welds the stretch film to the tray;

cutting means for thermally cutting the stretch film at a cut portion;

a heating body arranged to contact the peripheral portion of the tray surrounding the opening and contact the stretch film for welding the stretch film to the peripheral portion of the tray around the opening; and a film winding portion arranged to wind up the stretch film after said cutting means cuts the stretch film, said control means controlling said stretch mechanism, at least after said welding means welds the stretch film, to apply a tension to a portion of the stretch film near the cut portion in a direction perpendicular to a direction in which the stretch film is wound up.

2. The top-seal wrapping device according to claim 1, wherein the stretch film is thermally cut at a position outside a portion welded to the peripheral portion around the tray opening.

3. The top-seal wrapping device according to claim 1, further comprising a film supply mechanism arranged to supply the stretch film to a position above the tray;

a lift mechanism arranged to lift the tray to push the tray against the stretch film; and a tray holding portion arranged to hold the tray when welding the stretch film to the peripheral portion of the tray around the opening.

4. The top-seal wrapping device according to claim 3, wherein said tray holding portion prevents shifting of the tray position when the tray is lifted and pushed against the stretch film.

5. The top-seal wrapping device according to claim 3, wherein said tray holding portion contacts a side surface of the tray to prevent planar position shifting of the tray.

6. The top-seal wrapping device according to claim 3, further comprising a tray carrying and holding mechanism arranged to carry the tray thereon, and arranged to be transported to said lift mechanism together with the tray, wherein said tray holding portion forms a part of said tray carrying and holding mechanism, and said lift mechanism lifts the tray by lifting said tray carrying and holding mechanism.

7. The top-seal wrapping device according to claim 6, wherein said tray carrying and holding mechanism biases said tray holding portion toward the tray to adjust a planar position of the tray.

8. The top-seal wrapping device according to claim 3, further comprising position detecting means arranged to detect a positional state of the tray during transportation to said lift mechanism, wherein said control portion corrects shifting of position of the tray by said tray holding portion based on a result of a detection by said position detecting means.

9. The top-seal wrapping device according to claim 3, further comprising biasing means arranged to bias said tray holding portion toward the tray, wherein said control means controls a biasing force of said biasing means.

10. The top-seal wrapping device according to claim 9, further comprising biasing force detecting means arranged to detect the biasing force applied by said biasing means, wherein said control means controls the biasing force of said biasing means based on a result of the detection by said biasing force detecting means.

11. The top-seal wrapping device according to claim 9, wherein said control means controls the biasing force of said biasing means corresponding to the properties of at least one of the tray and the stretch film.

12. The top-seal wrapping device according to claim 1, further comprising a film supply mechanism arranged to supply the stretch film to a position above the tray;

a lift mechanism arranged to lift and push the tray against the stretch film;

a heating body arranged to contact the peripheral portion of the tray surrounding the opening and to contact the stretch film, and to weld the stretch film to the peripheral portion of the tray around the opening; and a position adjusting mechanism arranged to adjust a planar position of the tray before the tray comes into contact with the stretch film.

13. A top-seal wrapping device arranged to cover a top opening of a tray containing a wrapping target with a stretch film, and to weld the stretch film to a peripheral portion of the tray around the opening while thermally cutting the stretch film, comprising:

a stretch mechanism arranged to stretch the stretch film;

welding means for welding the stretch film to the peripheral portion of the tray;

control means operatively coupled to said stretch mechanism for controlling the stretching of the stretch film by operating said stretch mechanism at least before said welding means welds the stretch film to the tray;

cutting means for thermally cutting the stretch film at a cut portion;

a heating body arranged to contact the peripheral portion of the tray surrounding the opening and contact the stretch film for welding the stretch film to the peripheral portion of the tray around the opening;

a film winding portion arranged to wind up the stretch film after said cutting means cuts the stretch film, a film transporting mechanism arranged to transport the stretch film; and a lift mechanism arranged to lift the tray such that the tray is pushed against the film that is transported by said film transporting mechanism said control means controlling said stretch mechanism to stretch the stretch film before the tray contacts the stretch film, and further controlling said stretch mechanism to reduce tension of the stretch film after the tray contacts the stretch film and before the stretch film is welded to the tray.

14. The top-seal wrapping device according to claim 13, wherein said stretch mechanism is arranged between a supply position of the stretch film and an end of a position at which said welding means welds the stretch means.

15. The top-seal wrapping device according to claim 14, further comprising detecting means arranged to detect an opening in the stretch film formed by the thermal cutting by said cutting means, said control means controlling said stretch mechanism such that said stretch mechanism stops operation on at least a portion of the stretch film including and neighboring to the opening detected by said detecting means.

16. The top-seal wrapping device according to claim 15, wherein said stretch mechanism has a plurality of film holding portions for holding the stretch film.

17. The top-seal wrapping device according to claim 16, wherein at least one of said plurality of film holding portions is set to have different holding forces from that of another of said plurality of film holding portions.

18. The top-seal wrapping device according to claim 17, wherein said control means changes timing at which said plurality of film holding portions increases or reduces a tension of the stretch film based on the properties of at least one of the tray and the stretch film.

19. The top-seal wrapping device according to claim 18, wherein said stretch mechanism stretches the stretch film in at least one of a transporting direction of the stretch film and a width direction perpendicular to said transporting direction.

20. A top-seal wrapping method for covering a top opening of a tray containing a wrapping target with a stretch film, welding the stretch film to a peripheral portion of the tray around the opening and thermally cutting the stretch film, comprising steps of:

supplying a film by transporting the stretch film in a transporting direction to a position above the tray;

welding the stretch film to the peripheral portion of the tray;

stretching the stretch film in a direction crossing a direction in which the stretch film is transported at least before welding the stretch film to the tray;

cutting the stretch film thermally at a cut portion;

winding the remaining stretch film after the thermal cutting; and controllably stretching the remaining stretch film in a direction perpendicular to a direction in which the stretch film is wound up.

21. The top-seal wrapping method according to claim 20, further comprising steps of adjusting a planar position of the tray; and lifting the tray against the stretch film;

a heating body being brought into contact with a peripheral portion of the tray located around the opening and being in contact with the stretch film during said welding, and thereby welding the stretch film to the peripheral portion of the tray around the opening.

* * * * *